US007070517B2

(12) United States Patent
Cackett et al.

(10) Patent No.: US 7,070,517 B2
(45) **Date of Patent: *Jul. 4, 2006**

(54) GOLF CLUB HEAD (CORPORATE DOCKET PU2150)

(75) Inventors: Matthew T. Cackett, Encinitas, CA (US); Alan Hocknell, Encinitas, CA (US); D. Clayton Evans, San Macros, CA (US); J. Andrew Galloway, Escondido, CA (US)

(73) Assignee: Callaway Golf Company, Carlsbad, CA (US)

( * ) Notice: Subject to any disclaimer, the term of this patent is extended or adjusted under 35 U.S.C. 154(b) by 300 days.

This patent is subject to a terminal disclaimer.

(21) Appl. No.: 10/250,001

(22) Filed: May 27, 2003

(65) Prior Publication Data

US 2004/0248667 A1 Dec. 9, 2004

(51) Int. Cl.
*A63B 53/04* (2006.01)

(52) U.S. Cl. ..... 473/342; 473/345; 473/348

(58) Field of Classification Search ..... 473/345–346, 473/342, 348–349

See application file for complete search history.

(56) References Cited

U.S. PATENT DOCUMENTS

| | | | | | |
|---|---|---|---|---|---|
| 4,840,380 | A | * | 6/1989 | Kajita et al. | 473/291 |
| 6,152,833 | A | * | 11/2000 | Werner et al. | 473/324 |
| 6,162,133 | A | * | 12/2000 | Peterson | 473/345 |
| 6,248,024 | B1 | * | 6/2001 | Nelson et al. | 473/324 |
| 6,648,773 | B1 | * | 11/2003 | Evans | 473/342 |

FOREIGN PATENT DOCUMENTS

| | | | |
|---|---|---|---|
| JP | 2000-157651 | * | 6/2000 |

* cited by examiner

*Primary Examiner*—Stephen Blau
(74) *Attorney, Agent, or Firm*—Michael A. Catania; Elaine H. Lc

(57) ABSTRACT

A golf club head (20) having a center of gravity located relatively forward toward the front wall (30) or striking plate (40) of the golf club head (20), and a relatively high moment of inertia about the Iyy axis through the center of gravity of the golf club head (20) is disclosed. The golf club head (20) preferably has a volume between 300 cubic centimeters and 500 cubic centimeters. The golf club head (20) preferably has a mass between 105 grams and 300 grams. The positioning of the of the center of gravity of the golf club head (20) and the relatively high moment of inertia Iyy through the center of gravity provide for a golf club with greater robustness and better performance.

8 Claims, 18 Drawing Sheets

GOLF CLUB HEAD (CORPORATE DOCKET PU2150)

CROSS REFERENCE TO RELATED APPLICATIONS

Not Applicable

FEDERAL RESEARCH STATEMENT

[Not Applicable]

BACKGROUND OF INVENTION

1. Field of the Invention

The present invention relates to a golf club head designed with a forward center of gravity and a relatively high moment of inertia about the Iyy axis through the center of gravity.

2. Description of the Related Art

As driver golf club heads became larger in volume (>300 cubic centimeters) the moments of inertia of the drivers became larger, which provided greater forgiveness for off-center hits. The conventional method for enlargement of golf club heads was to maximize the spatial distribution of mass in all three orthogonal orientations. Although this approach was effective in increasing the moments of inertia of the golf club heads, it also resulted in the center of gravity of the golf club head being positioned substantially rearward from the face center point of the golf club head.

As the center of gravity is positioned rearward from the face, deleterious effects result for shots struck off-center from the sweet spot of the golf club head. Increased gear effect is the main cause of the deleterious effects. For heel-ward or toe-ward off-center hits, the increased gear effect can cause increased side-spin, which increases dispersion, reduces distance and reduces robustness. For off-center hits above the sweet spot, the increased gear effect causes reduced backspin, which can cause an undesirable trajectory having insufficient carry length or time of flight which in turn can result in reduced distance and reduced robustness.

In addition, the same conventional golf club head designs are limited with regard to the maximum face area, both physical and practical limitations. The physical limitation is due to the golf club head having insufficient mass to both increase the length and width of the golf club head, and also increase the face size without exceeding the upper range of the preferred total golf club head mass. Such mass distributions are dependent on minimum thickness values required to achieve acceptable in-service durability.

The practical limitation is that as the face size is increased, hit locations in certain regions around the face perimeter will yield an unsatisfactory ball flight due to the aforementioned deleterious effects which are accentuated for larger faces. The deleterious effects increase in a non-linear manner as distance from the face center increases so that the incremental face area gained by increasing face size will be subject to the most extreme deleterious effects. This limits the practical length of the club because probable hit distribution across the surface of the face broadens as the club length increases. As a result a longer club will yield a larger percentage of hits in the perimeter regions of the face where the deleterious effects occur. This offsets the otherwise beneficial effect of increased head speed. As club length increases head speed increases up to a length of approximately 52 inches at which point aerodynamic and biomechanical effects offset the length effect.

Further, conventional head designs having a center of gravity positioned substantially rearward from the face are subject to significant dynamic loft effects, which can be undesirable. Dynamic loft increases with head speed so that golfers with higher head speeds experience more dynamic loft than those with slower swing speeds. This is opposite of what is desired as higher head speeds generally require less loft, otherwise excess back spin will be generated, which negatively affects trajectory and performance.

One invention that addresses center of gravity depth is set forth in U.S. Pat. No. 6,344,002 to Kajita for a Wood Club Head. The Kajita invention discloses a golf club head with a center of gravity not more than 30 mm (1.18 inches) from the face. However, the Kajita invention does not address a high moment of inertia about the horizontal axis.

U.S. Pat. No. 6,146,571 to Vincent, et al., discloses a method of manufacturing a golf club head wherein the walls are obtained by injecting a material such as plastic over an insert affixed to a meltable core. The core has a melt point lower than that of the injectable plastic material so that once the core is removed, an inner volume is maintained to form the inner cavity. The insert may comprise a resistance element for reinforcing the internal portion of the front wall of the shell upon removal of the core where the reinforcement element is comprised of aluminum with a laterally extending portion comprised of steel.

U.S. Pat. No. 6,149,534 to Peters, et al., discloses a golf club head having upper and lower metal engagement surfaces formed along a single plane interface wherein the metal of the lower surface is heavier and more dense than the metal of the upper surface.

U.S. Pat. Nos. 5,570,886 and 5,547,427 to Rigal, et al., disclose a golf club head of molded thermoplastic having a striking face defined by an impact-resistant metallic sealing element. The sealing element defines a front wall of the striking surface of the club head and extends upward and along the side of the impact surface to form a neck for attachment of the shaft to the club head. The sealing element is preferably between 2.5 and 5 mm in thickness. U.S. Pat. No. 5,425,538 to Vincent, et al., discloses a hollow golf club head having a steel shell and a composite striking surface composed of a number of stacked woven webs of fiber.

U.S. Pat. No. 5,377,986 to Viollaz, et al., discloses a golf club head having a body composed of a series of metal plates and a hitting plate comprised of plastic or composite material wherein the hitting plate is imparted with a forwardly convex shape. Additionally, U.S. Pat. No. 5,310,185 to Viollaz, et al., discloses a hollow golf club head having a body composed of a series of metal plates, a metal support plate being located on the front hitting surface to which a hitting plate comprised of plastic or composite is attached. The metal support plate has a forwardly convex front plate associated with a forwardly convex rear plate of the hitting plate thereby forming a forwardly convex hitting surface.

U.S. Pat. No. 5,106,094 to Desboilles, et al., discloses a golf club head having a metal striking face plate wherein the striking face plate is a separate unit attached to the golf club head with a quantity of filler material in the interior portion of the club head.

U.S. Pat. No. 4,568,088 to Kurahashi discloses a wooden golf club head body reinforced by a mixture of wood-plastic composite material. The wood-plastic composite material being unevenly distributed such that a higher density in the range of between 5 and 15 mm lies adjacent to and extends substantially parallel with the front face of the club head. U.S. Pat. No. 4,021,047 to Mader discloses a golf club wherein the sole plate, face plate, heel, toe and hosel portions are formed as a unitary cast metal piece and wherein a wood or composite crown is attached to this unitary piece thereby forming a hollow chamber in the club head.

U.S. Pat. No. 5,624,331 to Lo, et al. discloses a hollow metal golf club head where the metal casing of the head is composed of at least two openings. The head also contains a composite material disposed within the head where a portion of the composite material is located in the openings of the golf club head casing.

U.S. Pat. No. 1,167,387 to Daniel discloses a hollow golf club head wherein the shell body is comprised of metal such as aluminum alloy and the face plate is comprised of a hard wood such as beech, persimmon or the like. The face plate is aligned such that the wood grain presents endwise at the striking plate.

U.S. Pat. No. 3,692,306 to Glover discloses a golf club head having a bracket with sole and striking plates formed integrally thereon. At least one of the plates has an embedded elongate tube for securing a removably adjustable weight means.

U.S. Pat. No. 5,410,798 to Lo discloses a method of manufacturing a composite golf club head using a metal casing to which a laminated member is inserted. A sheet of composite material is subsequently layered over the openings of the laminated member and metal casing to close off the openings in the top of both. An expansible pocket is then inserted into the hollow laminated member comprising sodium nitrite, ammonium chloride and water causing the member to attach integrally to the metal casing when the head is placed into a mold and heated.

U.S. Pat. No. 4,877,249 to Thompson discloses a wood golf club head embodying a laminated upper surface and metallic sole surface having a keel. In order to reinforce the laminations and to keep the body from delaminating upon impact with an unusually hard object, a bolt is inserted through the crown of the club head where it is connected to the sole plate at the keel and tightened to compress the laminations.

U.S. Pat. No. 3,897,066 to Belmont discloses a wooden golf club head having removably inserted weight adjustment members. The members are parallel to a central vertical axis running from the face section to the rear section of the club head and perpendicular to the crown to toe axis. The weight adjustment members may be held in place by the use of capsules filled with polyurethane resin, which can also be used to form the faceplate. The capsules have openings on a rear surface of the club head with covers to provide access to adjust the weight means.

U.S. Pat. No. 2,750,194 to Clark discloses a wooden golf club head with weight adjustment means. The golf club head includes a tray member with sides and bottom for holding the weight adjustment preferably cast or formed integrally with the heel plate. The heel plate with attached weight member is inserted into the head of the golf club via an opening.

U.S. Pat. No. 5,193,811 to Okumoto, et al. discloses a wood type club head body comprised primarily of a synthetic resin and a metallic sole plate. The metallic sole plate has on its surface for bonding with the head body integrally formed members comprising a hosel on the heel side, weights on the toe and rear sides and a beam connecting the weights and hosel. Additionally, U.S. Pat. No. 5,516,107 to Okumoto, et al., discloses a golf club head having an outer shell, preferably comprised of synthetic resin, and metal weight member/s located on the interior of the club head. A foamable material is injected into the hollow interior of the club to form the core. Once the foamable material has been injected and the sole plate is attached, the club head is heated to cause the foamable material to expand thus holding the weight member/s in position in recess/es located in toe, heel and/or back side regions by pushing the weight member into the inner surface of the outer shell.

U.S. Pat. No. 4,872,685 to Sun discloses a wood type golf club head wherein a female unit is mated with a male unit to form a unitary golf club head. The female unit comprises the upper portion of the golf club head and is preferably composed of plastic, alloy, or wood. The male unit includes the structural portions of sole plate, a face insert consists of the striking plate and weighting elements. The male unit has a substantially greater weight being preferably composed of a light metal alloy. The units are mated or held together by bonding and or mechanical means.

U.S. Pat. No. 5,398,935 to Katayama discloses a wood golf club head having a striking face wherein the height of the striking face at a toe end of the golf club head is nearly equal to or greater than the height of the striking face at the center of the club head.

U.S. Pat. No. 1,780,625 to Mattern discloses a club head with a rear portion composed of a light-weight metal such as magnesium. U.S. Pat. No. 1,638,916 to Butchart discloses a golf club with a balancing member composed of persimmon or a similar wood material, and a shell-like body composed of aluminum attached to the balancing member.

Anderson, U.S. Pat. Nos. 5,024,437, 5,094,383, 5,255,918, 5,261,663 and 5,261,664 disclose a golf club head having a full body composed of a cast metal material and a face insert composed of a hot forged metal material.

Viste, U.S. Pat. No. 5,282,624 discloses a golf club head with a cast metal body and a forged steel face insert with grooves on the exterior surface and the interior surface of the face insert and having a thickness of 3 mm.

Rogers, U.S. Pat. No. 3,970,236, discloses an iron club head with a formed metal face plate insert fusion bonded to a cast iron body.

Aizawa, U.S. Pat. No. 5,242,168 discloses a golf club head having a fiber reinforced resin body with a thin metallic film layer.

Yamada, U.S. Pat. No. 4,535,990 discloses a golf club head having a fiber reinforced resin body with a face insert composed of a polycarbonate or like material.

Aizawa et al., U.S. Pat. No. 5,465,968 discloses a golf club head having a fiber reinforced resin body with a beryllium face plate.

The Rules of Golf, established and interpreted by the United States Golf Association ("USGA") and The Royal and Ancient Golf Club of Saint Andrews, set forth certain requirements for a golf club head. The requirements for a golf club head are found in Rule 4 and Appendix II. A complete description of the Rules of Golf are available on the USGA web page at www.usga.org. Although the Rules of Golf do not expressly state specific parameters for a golf club face, Rule 4-1e prohibits the face from having the effect at impact of a spring with a golf ball. In 1998, the USGA adopted a test procedure pursuant to Rule 4-1e which measures club face COR. This USGA test procedure, as well as procedures like it, may be used to measure club face COR.

SUMMARY OF INVENTION

The present invention is generally directed at a golf club head that has a forward center of gravity, positioned relatively close to a striking plate of the golf club head, and relatively high moments of inertia about the Y and Z axes through the center of gravity of the golf club head.

The golf club head of the present invention provides increased distance and straightness for off-center hits, more stable feel and increased spin robustness. The positioning of the center of gravity closer to the front wall reduces the gear effect which reduces side spin, dispersion and shot curvature resulting in a more consistent ball flight, improved accuracy and increased distance.

Having briefly described the present invention, the above and further objects, features and advantages thereof will be recognized by those skilled in the pertinent art from the following detailed description of the invention when taken in conjunction with the accompanying drawings.

DETAILED DESCRIPTION

Figure 1:
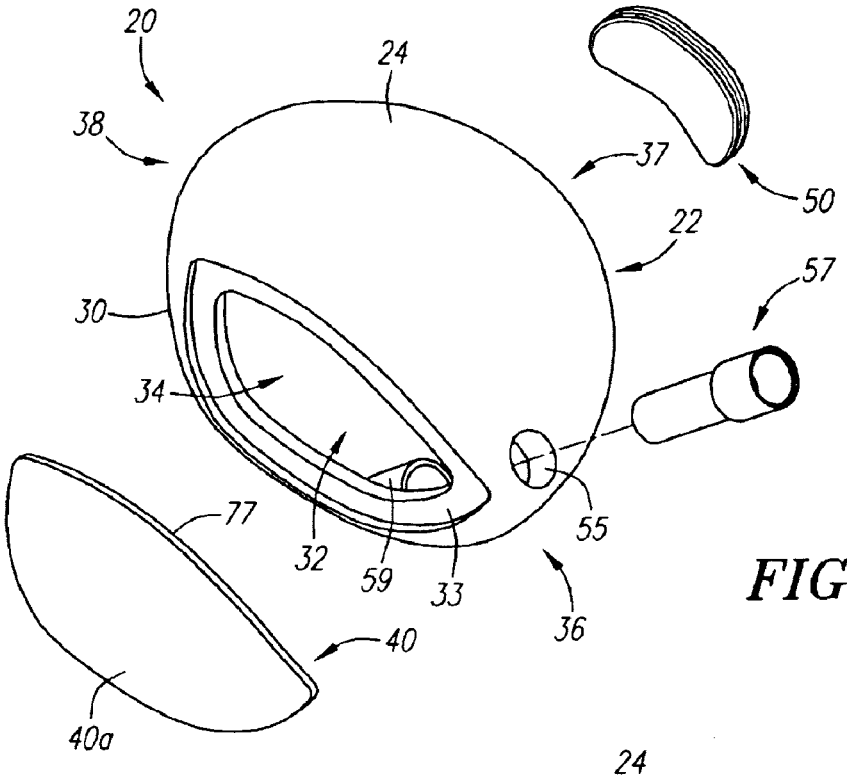
FIG. 1 is an exploded top perspective view of a golf club of the present invention.
Figure 2:
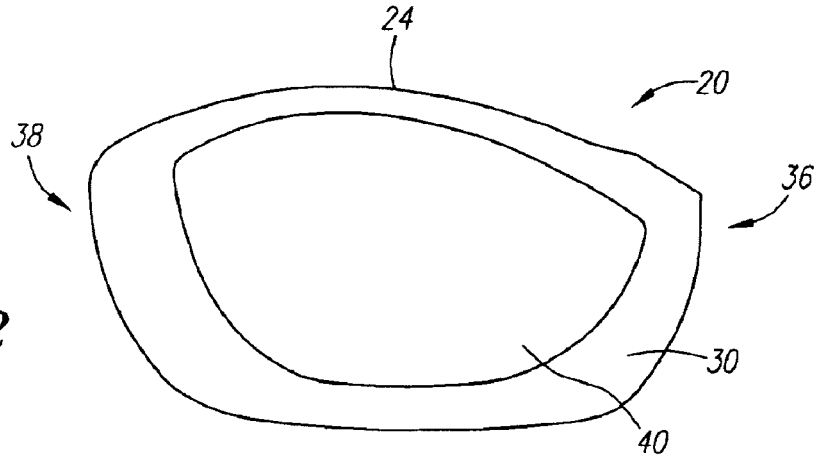
FIG. 2 is a front view of a golf club head of the present invention.

The present invention is generally directed at a golf club head that has a center of gravity positioned relatively close to a striking plate of the golf club head and relatively high moments of inertia about the Y and Z axes through the center of gravity of the golf club head. A preferred embodiment of the golf club head of the present invention is illustrated in FIGS. 1–15. An alternative embodiment of the present invention is illustrated in FIGS. 16–22. A second alternative embodiment of the golf club head of the present invention of the present invention is illustrated in FIGS. 23–28. Although three embodiments are illustrated, those skilled in the pertinent art will recognize from this disclosure that other embodiments of the golf club head of the present invention are possible without departing from the scope and spirit of the present invention.

A golf club head of the present invention is generally designated 20. Preferably, the golf club head 20 includes a body 22 having a crown 24, a sole 26, a ribbon 28, a front wall 30 and a hollow interior 34. The golf club head 20 has a heel end 36, a toe end 38, and an aft end 37.

The golf club head 20, when designed as a driver, preferably has a volume from 200 cubic centimeters to 600 cubic centimeters, more preferably from 300 cubic centimeters to 450 cubic centimeters, and most preferably from 350 cubic centimeters to 420 cubic centimeters. The volume of the golf club head 20 will also vary between fairway woods (preferably ranging from 3-woods to eleven woods) with smaller volumes than drivers.

The golf club head 20, when designed as a driver, preferably has a mass no more than 215 grams, and more preferably a mass of 180 to 215 grams. When the golf club head 20 is designed as a fairway wood, the golf club head preferably has a mass of 190 grams to 230 grams, and more preferably a mass of 200 grams to 220 grams.

As shown in FIGS. 1–15, a preferred embodiment of the golf club head 20 has the front wall 30 with an opening 32 and preferably a recessed portion 33. A striking plate 40 is preferably disposed within the opening. The ribbon 28 has an aft recess 52 located opposite of the striking plate insert 40, and a rear weighting member 50 is preferably disposed within the aft recess 52. In the preferred embodiment, the body 22 is preferably composed of a non-metal material, preferably a composite material such as a continuous fiber pre-preg material (including thermosetting materials or a thermoplastic materials for the resin). Other materials for the body 22 include other thermosetting materials or other thermoplastic materials such as injectable plastics. Further, other materials for the body 22 include magnesium alloys, aluminum alloys, magnesium, aluminum or other low density metals. The body 22 is preferably manufactured through bladder-molding, resin transfer molding, resin infusion, injection molding, compression molding, or a similar process.

The striking plate insert 40 is attached to the body 22 over the opening 32 of the front wall 30. Preferably the striking plate insert 40 is positioned over and attached to the recessed portion 33 of the front wall 30.

The striking plate insert 40 is preferably composed of a formed metal material. However alternatively, the striking plate insert 40 is composed of a machined metal material, a forged metal material, a cast metal material or the like. The striking plate insert 40 preferably is composed of a formed titanium or steel material. A preferred material is steel 4340, which is heat treated and then coated with a material, such as titanium nitride. Titanium materials useful for the striking plate insert 40 include pure titanium and titanium alloys such as 6-4 titanium alloy, SP-700 titanium alloy (available from Nippon Steel of Tokyo, Japan), DAT 55G titanium alloy available from Diado Steel of Tokyo, Japan, Ti 10-2-3 Beta-C titanium alloy available from RTI International Metals of Ohio, and the like. Other metals for the striking plate insert 40 include other high strength steel alloy metals and amorphous metals. Such steel materials include 17-4PH, Custom 450, 455, 465 and 465+ stainless steels, AERMET 100 and AERMET 310 alloy steels, all available from Carpenter Specialty Alloys, of Pennsylvania, and C35 maraging steels available from Allvac of North Carolina. Such amorphous metals include beryllium based alloys such as disclosed in U.S. Pat. No. 5,288,344, which pertinent parts are hereby incorporated by reference, quinary metallic glass alloys such as disclosed in U.S. Pat. No. 5,735,975, which pertinent parts are hereby incorporated by reference, and ternary alloys as disclosed in *Calculations of Amorphous-Forming Composition Range For Ternary Alloy Systems And Analyses Of Stabilization Of Amorphous Phase And Amorphous-Forming Ability, Takeuchi and Inoue*, Materials Transactions, Vol. 42, No. 7, p 1435–1444 (2001), which pertinent parts are hereby incorporated by reference. The exterior surface 40*a* of the striking plate insert 40 typically has a plurality of scorelines thereon, not shown.

In a preferred embodiment, the striking plate insert 40 has uniform thickness that ranges from 0.040 inch to 0.250 inch, more preferably a thickness of 0.080 inch to 0.120 inch, and is most preferably 0.108 inch for a titanium alloy striking plate insert 40 and 0.090 inch for a stainless steel striking plate insert 40.

The striking plate insert 40 is preferably co-molded with a body 22 or press-fitted into the opening subsequent to fabrication of the body 22. In another attachment process, the body 22 is first bladder molded and then the striking plate insert 40 is bonded to the recessed portion 33 of the front wall 30 using an adhesive. The adhesive is placed on the exterior surface of the recessed portion 33. Such adhesives include thermosetting adhesives in a liquid or a film medium. A preferred adhesive is a two part liquid epoxy sold by 3M of Minneapolis, Minn. under the brand names DP420NS and DP460NS. Other alternative adhesives include modified acrylic liquid adhesives such as DP810NS, also sold by the 3M company. Alternatively, foam tapes such as Hysol Synspan may be utilized with the present invention. In yet another attachment process, the body 22 is bladder molded, and the striking plate insert 40 is mechanically secured to the body 22. Those skilled in the pertinent art will recognize other methods for attachment of the striking plate insert 40 to the body 22 without departing from the scope and spirit of the present invention.

As mentioned above, in a preferred embodiment, the body 22 is composed of a plurality of plies of pre-preg, typically six or seven plies (preferably ranging from three plies to twenty plies) such as disclosed in U.S. Pat. No. 6,248,025, entitled Composite Golf Head And Method Of Manufacturing, which is hereby incorporated by reference in its entirety. In such an embodiment, the crown 24, the sole 26 and the ribbon 28 preferably range in thickness from 0.010 to 0.100 inch, more preferably from 0.025 inch to 0.070 inch, even more preferably from 0.028 inch to 0.040 inch, and most preferably have a thickness of 0.033 inch. The front wall 30 preferably has a thickness greater than the thickness of the crown 24, sole 26 or ribbon 28. The thickness of the front wall preferably ranges from 0.040 to 0.400 inch, more preferably from 0.120 inch to 0.380 inch, even more preferably from 0.220 inch to 0.350 inch, and most preferably the front wall 30 has a thickness of 0.320 inch at its widest dimension.

Figure 11:
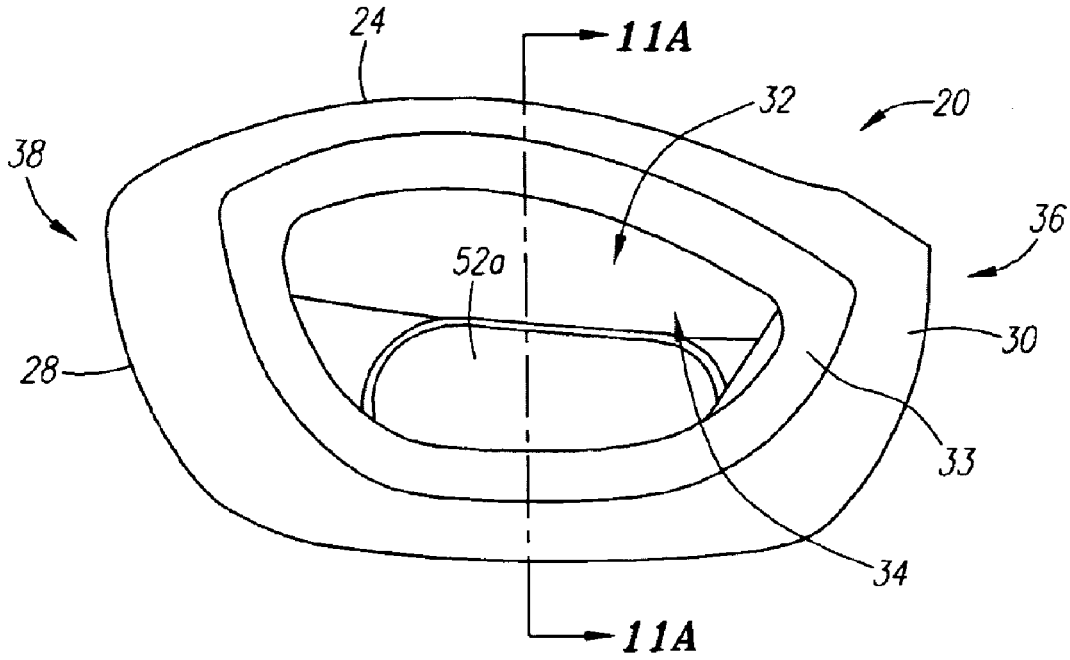
FIG. 11 is a front view of the body of a golf club head of the present invention without a striking plate insert.
Figure 11A:
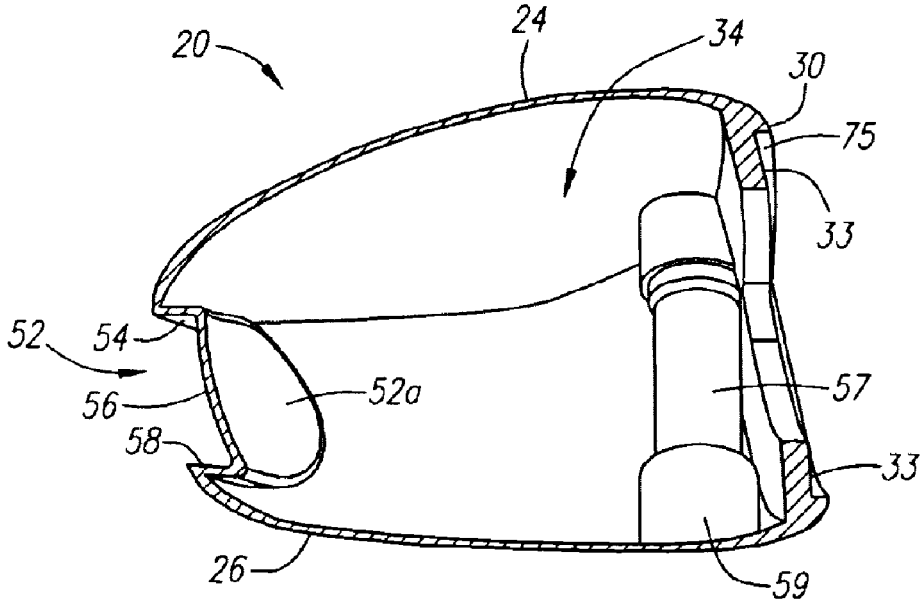
FIG. 11A is a cross-sectional view taken along line 11A—11A of FIG. 11.

FIGS. 11 and 11A best illustrate the hollow interior 34 of the club head 20. As shown in FIGS. 11 and 11A, the recessed portion 33 of the front wall 30 encompasses the opening 32 forming a support for placement and attachment of the striking plate insert 40 thereon. The front wall 30 has a shoulder 75 that preferably engages a perimeter 77 of the striking plate insert 40. A portion of the interior surface 40*b* of the striking plate insert 40 will engage the exterior surface of the recessed portion 33 of the front wall 30. The thickness of the recessed portion 33 of the front wall 30 is preferably thicker than the crown 24, the sole 26 or the ribbon 28.

Also shown in FIG. 11A is the hosel 57, which is disposed within the hollow interior 34, and is located near the heel end 36. The hosel 57 is preferably composed of a stainless steel material, and preferably has a mass ranging from 3 to 17 grams, more preferably from 8 to 15 grams, and most preferably has a mass of 13 grams. Alternatively, the hosel 57 is composed of a strong polymer material such as a urethane or ABS material. In a preferred embodiment, a shaft, not shown, is disposed within a hosel insert, not shown, that is disposed within the hosel 57 through the crown bore 55. Such a hosel insert is described in U.S. Pat. No. 6,352,482, entitled Golf Club With Hosel Liner, which pertinent parts are hereby incorporated by reference. The hosel 57 is preferably positioned in a hosel base 59 and extends from the sole 26 to the crown 24. However, those skilled within the pertinent art will recognize that the hosel may extend outside of the body 22 without departing from the scope and spirit of the present invention.

Figure 3:
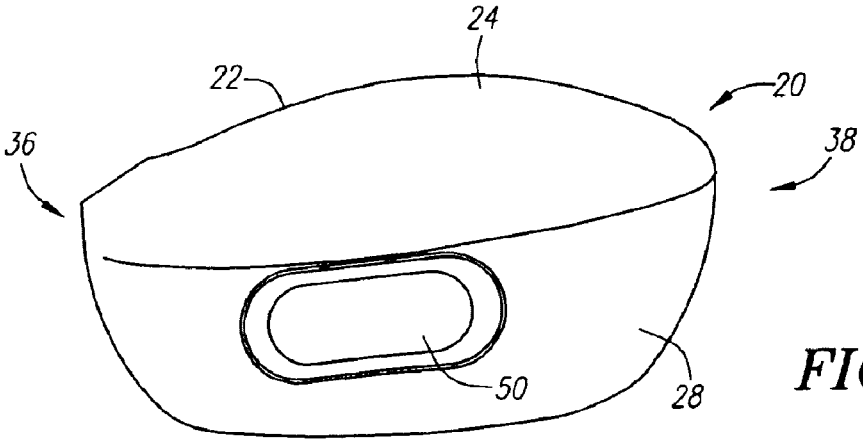
FIG. 3 is a rear view of the golf club head of FIG. 1.
Figure 4:
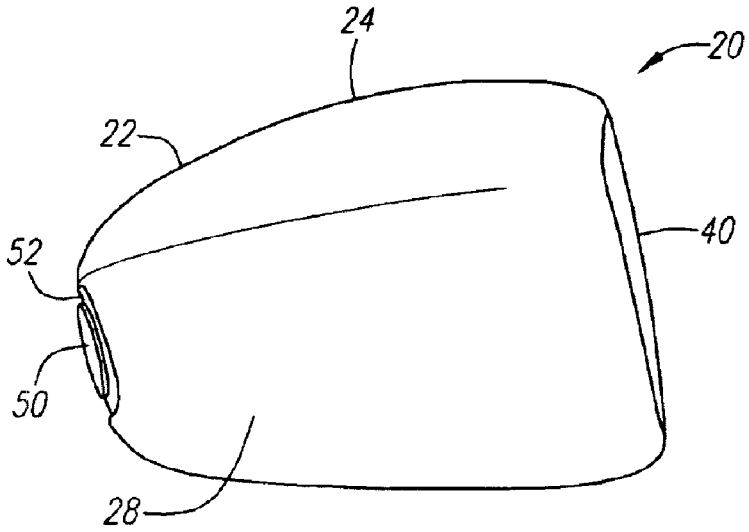
FIG. 4 is toe side view of the golf club head of FIG. 1.
Figure 5:
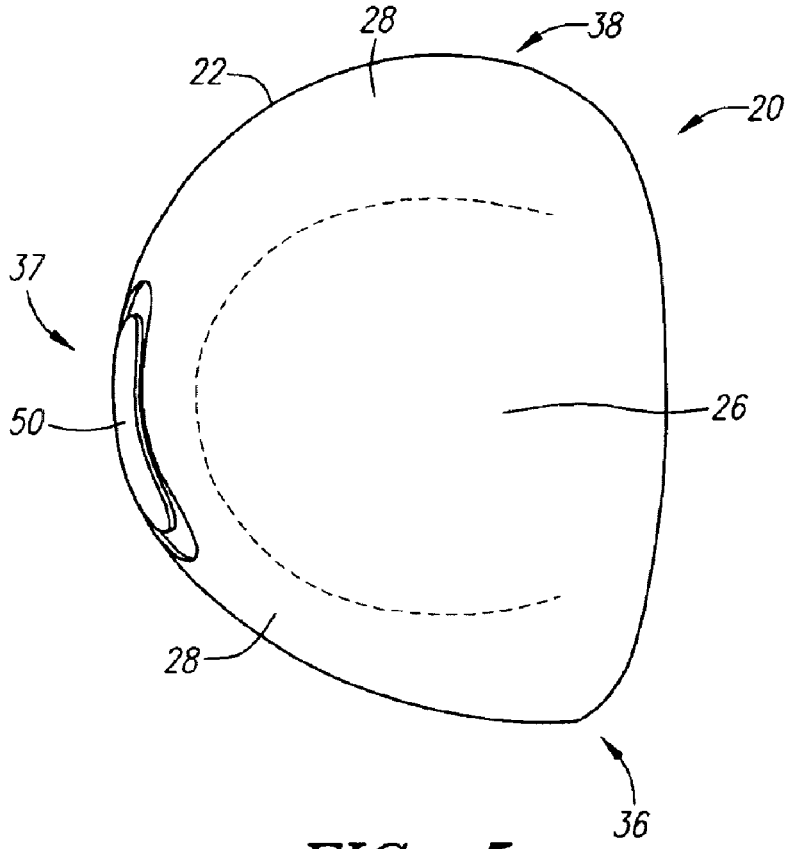
FIG. 5 is a bottom plan view of the golf club head of FIG. 1.
Figure 6:
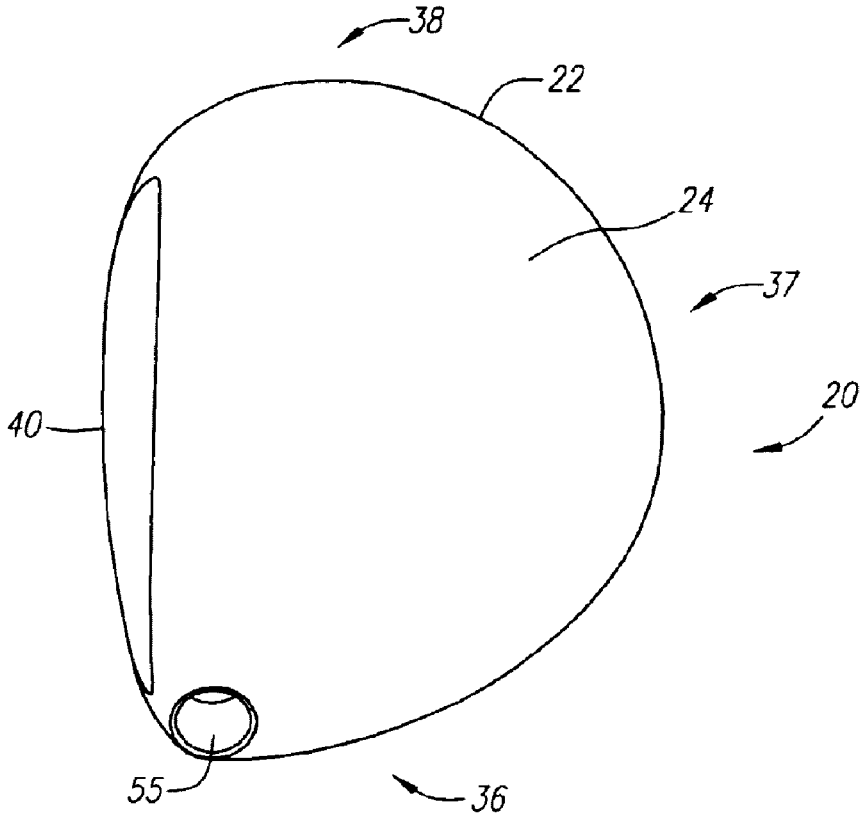
FIG. 6 is a top plan view of the golf club head of FIG. 1.
Figure 7:
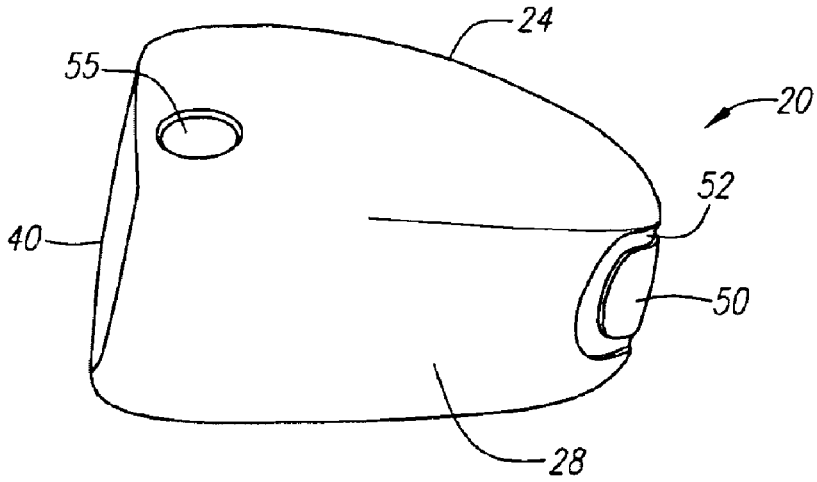
FIG. 7 is a heel side view of the golf club head of FIG. 1.
Figure 8:
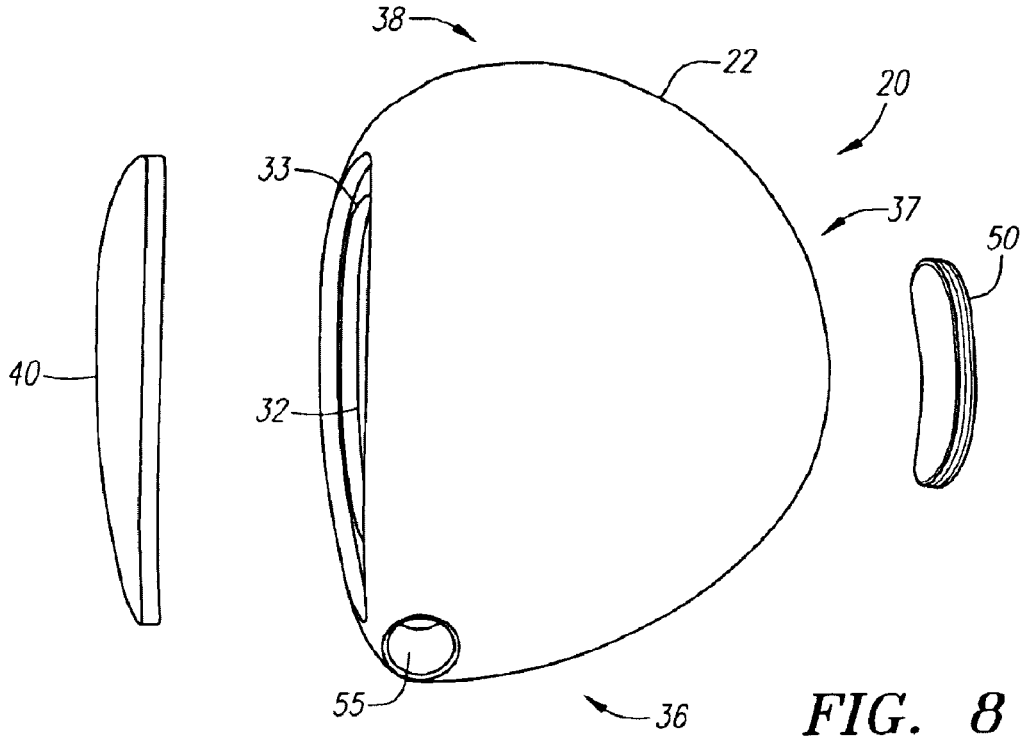
FIG. 8 is an exploded top view of a golf club head of the present invention.
Figure 9:
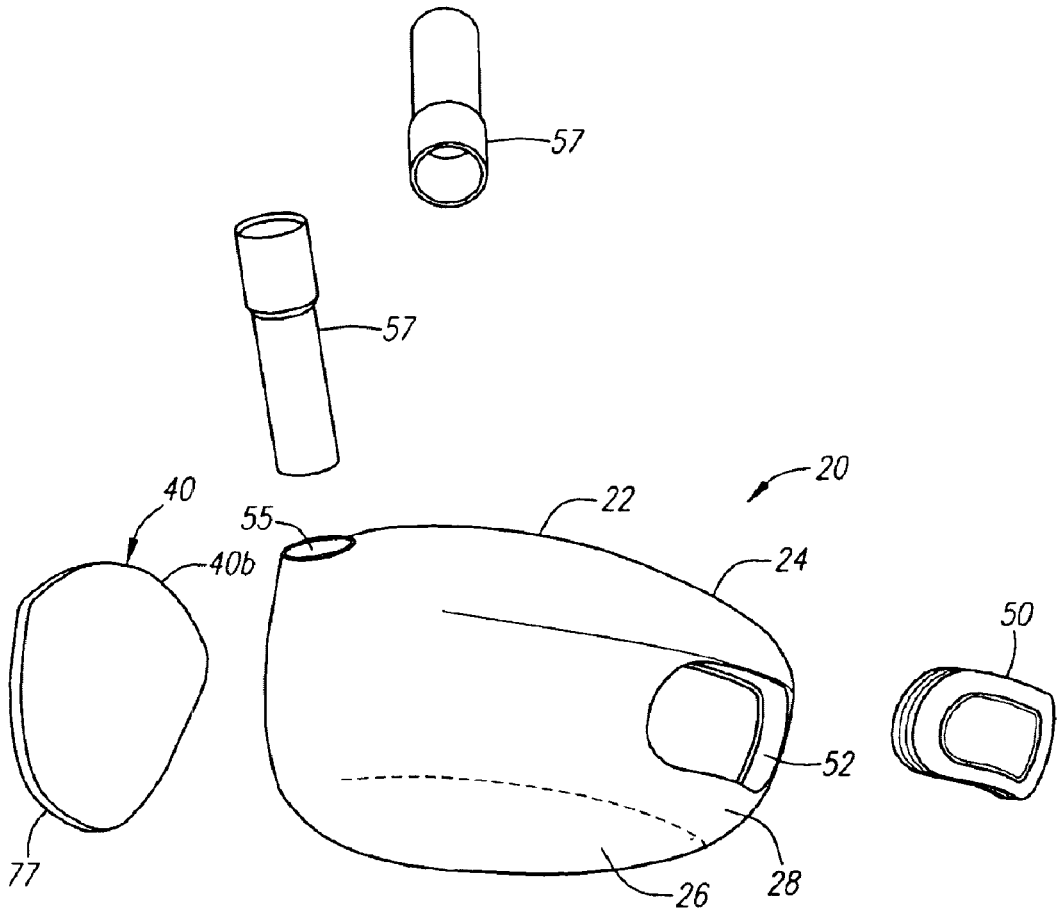
FIG. 9 is an exploded rear perspective view of a golf club of the present invention.
Figure 10:
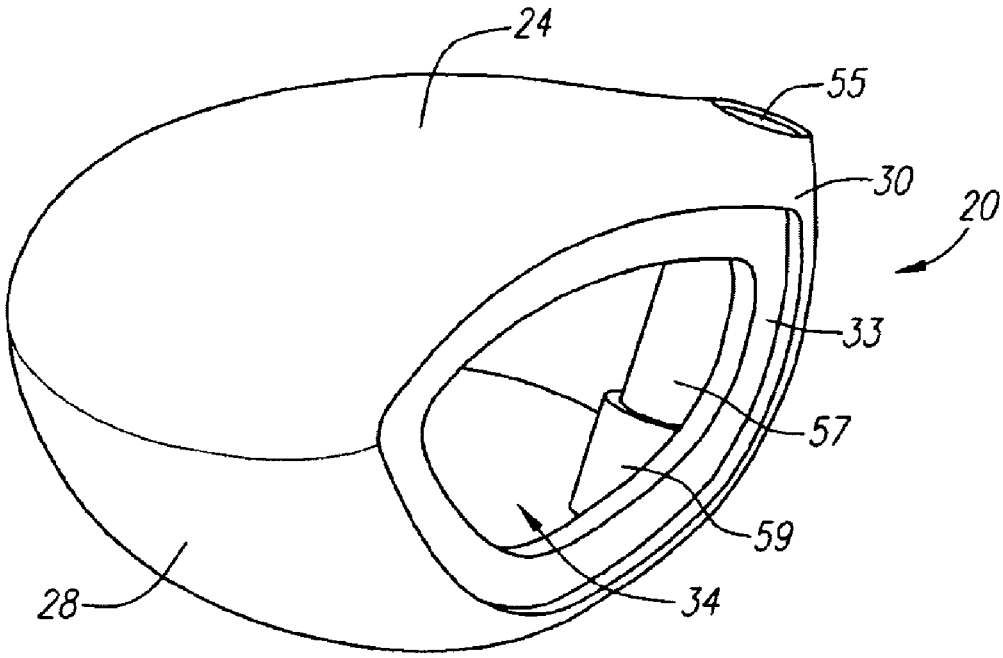
FIG. 10 is a perspective view of a body of a golf club head of the present invention without a striking plate insert.

Also shown in FIGS. 11 and 11A are the walls of the aft recess 52. The aft recess 52 preferably extends into the hollow interior 34 forming an aft recess projection 52*a*. The aft recess 52 is preferably defined by upper recess wall 54, main recess wall 56 and lower recess wall 58. The rear weighting member 50 is positioned within the aft recess 52, as best shown in FIG. 3.

The rear weighting member 50 is preferably composed of a metal material such as steel, steel alloys, brass, tungsten, tungsten alloys, pewter, or other high density materials. The rear weighting material 50 has a mass preferably ranging from 15 grams to 60 grams. The rear weighting member 50 is preferably co-molded with a body 22 or press-fitted within the aft recess 52 subsequent to fabrication of the body 22. In another attachment process, the body 22 is first bladder molded and then the rear weighting member 50 is bonded within the aft recess 52 using an adhesive. The adhesive is placed on the exterior surface of the walls 54, 56 and 58 that define the aft recess 52. Such adhesives include thermosetting adhesives in a liquid or a film medium. A preferred adhesive is a two part liquid epoxy sold by 3M of Minneapolis, Minn. under the brand names DP420NS and DP460NS. Other alternative adhesives include modified acrylic liquid adhesives such as DP810NS, also sold by the 3M company. Alternatively, foam tapes such as Hysol Synspan may be utilized with the present invention. In yet another attachment process, the body 22 is bladder molded, and the rear weighting member 50 is mechanically secured within the aft recess 52. Those skilled in the pertinent art will recognize other methods for attachment of the rear weighting member 50 within the aft recess 52 without departing from the scope and spirit of the present invention.

An alternative embodiment of the golf club head of the present invention is shown in FIGS. 16–22. In this embodiment, the club head 20 is generally composed of two components, a face component 60 and an aft-body 61, and a more thorough description of such a golf club head 20 is set forth in U.S. Pat. No. 6,758,763, for a Multiple Material Golf Club Head, and assigned to the assignee of the present application, and which is hereby incorporated by reference in its entirety. The aft-body 61 has a crown portion 62 and a sole portion 64. The club head 20 is preferably partitioned into a heel end 36, a toe end 38 opposite the heel section 36, and an aft end 37 opposite the face component 60. A sole weighting member 133 is preferably disposed within a sole undercut portion 133*a* of the sole portion. The sole weighing member has a mass ranging from 0.5 grams to 15 grams.

The face component 60 is generally composed of a single piece of metal, and is preferably composed of a forged metal material. More preferably, the forged metal material is a forged titanium material. Such titanium materials include pure titanium and titanium alloys such as 6–4 titanium alloy, SP-700 titanium alloy (available from Nippon Steel of Tokyo, Japan), DAT 55G titanium alloy available from Diado Steel of Tokyo, Japan, Ti 10-2-3 Beta-C titanium alloy available from RTI International Metals of Ohio, and the like. Other metals for the face component 60 include stainless steel, other high strength steel alloy metals and amorphous metals. Alternatively, the face component 60 is manufactured through casting, forming, machining, powdered metal forming, metal-injection-molding, electro chemical milling, and the like.

The face component 60 generally includes a striking plate portion (also referred to herein as a face plate) 72 and a return portion 74 extending laterally inward from the perimeter of the striking plate portion 72. The striking plate portion 72 typically has a plurality of scorelines 75 thereon.

In a preferred embodiment, the return portion 74 generally includes an upper lateral section 76, a lower lateral section 78 with a sole extension 95, a heel lateral section 80 and a toe lateral section 82. Thus, the return 74 preferably encircles the striking plate portion 72 a full 360 degrees. However, those skilled in the pertinent art will recognize that the return portion 74 may only encompass a partial section of the striking plate portion 72, such as 270 degrees or 180 degrees, and may also be discontinuous.

The upper lateral section 76 extends inward, towards the aft-body 61, a predetermined distance, d, to engage the crown 62. In a preferred embodiment, the predetermined distance ranges from 0.2 inch to 1.0 inch, more preferably 0.40 inch to 0.75 inch, and most preferably 0.68 inch, as measured from the perimeter 73 of the striking plate portion 72 to the rearward edge of the upper lateral section 76. In a preferred embodiment, the upper lateral section 76 has a general curvature from the heel section 66 to the toe section 68. The upper lateral section 76 has a length from the perimeter 73 of the striking plate section 72 that is preferably a minimal length near the center of the striking plate section 72, and increases toward the toe section 68 and the heel section 66.

The perimeter 73 of the striking plate portion 74 is defined as the transition point where the face component 60 transitions from a plane substantially parallel to the striking plate portion 72 to a plane substantially perpendicular to the striking plate portion 72. Alternatively, one method for determining the transition point is to take a plane parallel to the striking plate portion 72 and a plane perpendicular to the striking plate portion, and then take a plane at an angle of forty-five degrees to the parallel plane and the perpendicular plane. Where the forty-five degrees plane contacts the face component is the transition point thereby defining the perimeter of the striking plate portion 72.

The present invention preferably has the face component 60 engage the crown 62 along a substantially horizontal plane. The crown 62 has a crown undercut portion 62*a*, which is placed under the return portion 74. Such an engagement enhances the flexibility of the striking plate portion 72 allowing for a greater coefficient of restitution. The crown 62 and the upper lateral section 76 are attached to each other as further explained below.

The heel lateral section 80 is substantially perpendicular to the striking plate portion 72, and the heel lateral section 80 covers the hosel 57 before engaging an optional ribbon section 90 and a bottom section 91 of the sole portion 64 of the aft-body 61. The heel lateral section 80 is attached to the sole 64, both the ribbon 90 and the bottom section 91, as explained in greater detail below. The heel lateral section 80 extends inward a distance, d''', from the perimeter 73 a distance of 0.250 inch to 1.50 inches, more preferably 0.50 inch to 1.0 inch, and most preferably 0.950 inch. The heel lateral section 80 preferably has a general curvature at its edge.

At the other end of the face component 60 is the toe lateral section 82. The toe lateral section 82 is attached to the sole 64, both the ribbon 90 and the bottom section 91, as explained in greater detail below. The toe lateral section 82 extends inward a distance, d'', from the perimeter 73 a distance of 0.250 inch to 1.50 inches, more preferably 0.75 inch to 1.30 inch, and most preferably 1.20 inch. The toe lateral section 80 preferably has a general curvature at its edge.

The lower lateral section 78 extends inward, toward the aft-body 61, a distance, d', to engage the sole 64, and a sole extension 95 extends further inward a distance $d^5$ to preferably function as protection for the sole of the club head 20. In a preferred embodiment, the distance d' ranges from 0.2 inch to 1.25 inches, more preferably 0.50 inch to 1.10 inch, and most preferably 0.9 inch, as measured from the perimeter 73 of the striking plate portion 72 to the edge of the lower lateral section 78. In a preferred embodiment, the distance $d^5$ ranges from 0.2 inch to 3.0 inches, more preferably 0.50 inch to 2.0 inches, and most preferably 1.50 inch, as measured from the edge of the lower lateral section 78 to an apex 97 of the sole extension 95. In a preferred embodiment, the sole extension is triangular in shape with minor apices 99. In an alternative embodiment, not shown, the sole extension 95 has a crescent shape. In yet a further alternative, not shown, the sole extension 95 has a rectangular shape, and extends to the ribbon 90. Those skilled in the pertinent art will recognize that the sole extension 95 may have various shapes and sizes without departing from the scope and spirit of the present invention.

The aft-body 61 is preferably composed of a non-metal material, preferably a composite material such as continuous fiber pre-preg material (including thermosetting materials or a thermoplastic materials for the resin). Other materials for the aft-body 61 include other thermosetting materials or other thermoplastic materials such as injectable plastics. Further, other materials for the aft-body 61 include magnesium alloys, aluminum alloys, magnesium, aluminum or other low density metals. The aft-body 61 is preferably manufactured through bladder-molding, resin transfer molding, resin infusion, injection molding, compression molding, or a similar process. In a preferred process, the face component 60, with an adhesive on the interior surface of the return portion 74, is placed within a mold with a preform of the aft-body 61 for bladder molding. The return portion 74 is placed and fitted into the undercut portions 62*a* and 64*a*. Also, the adhesive may be placed on the undercut portions 62*a* and 64*a*. Such adhesives include thermosetting adhesives in a liquid or a film medium. A preferred adhesive is a two part liquid epoxy sold by 3M of Minneapolis, Minn. under the brand names DP420NS and DP460NS. Other alternative adhesives include modified acrylic liquid adhesives such as DP810NS, also sold by the 3M company. Alternatively, foam tapes such as Hysol Synspan may be utilized with the present invention.

A bladder is placed within the hollow interior of the preform and face component 60, and is pressurized within the mold, which is also subject to heating. The co-molding process secures the aft-body 61 to the face component 60. Alternatively, the aft-body 61 is bonded to the face component 60 using an adhesive, or mechanically secured to the return portion 74.

Figure 21:
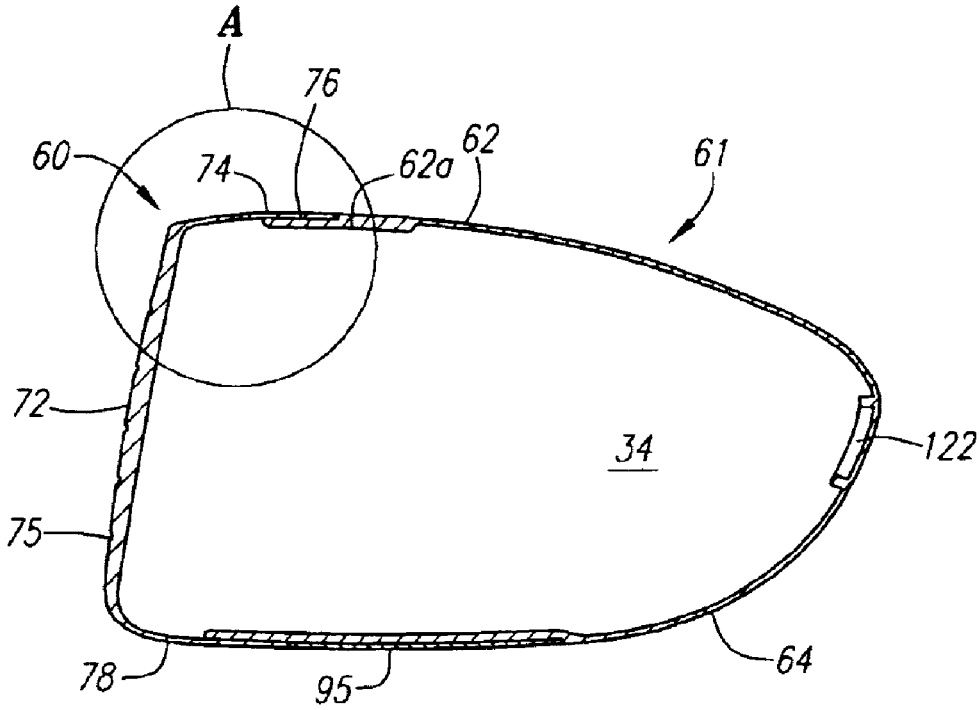
FIG. 21 is a cross-section view taken along line 21—21 of FIG. 19.
Figure 22:
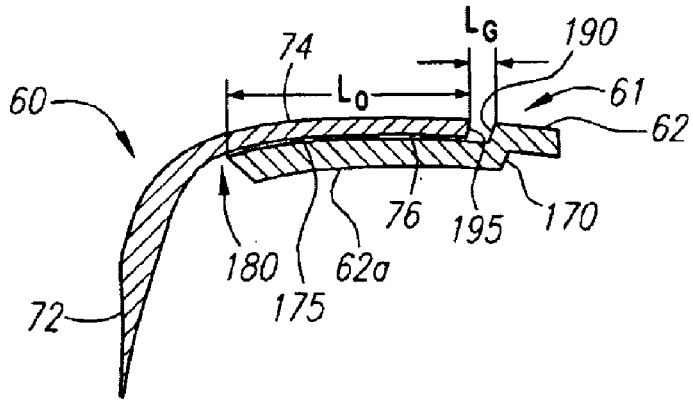
FIG. 22 is an isolated enlarged view of circle A of FIG. 21.
Figure 23:
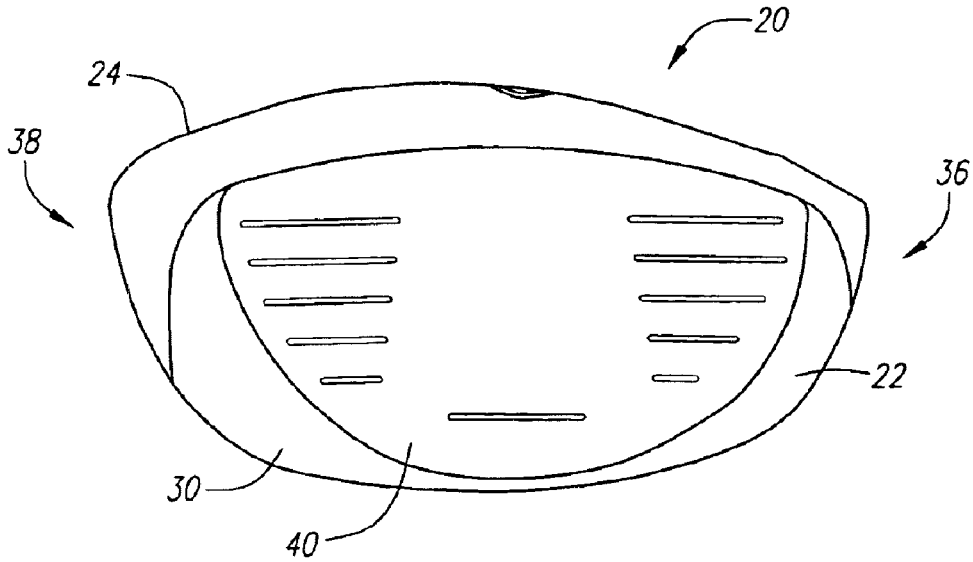
FIG. 23 is a front view of an alternative embodiment of a golf club head of the present invention.
Figure 24:
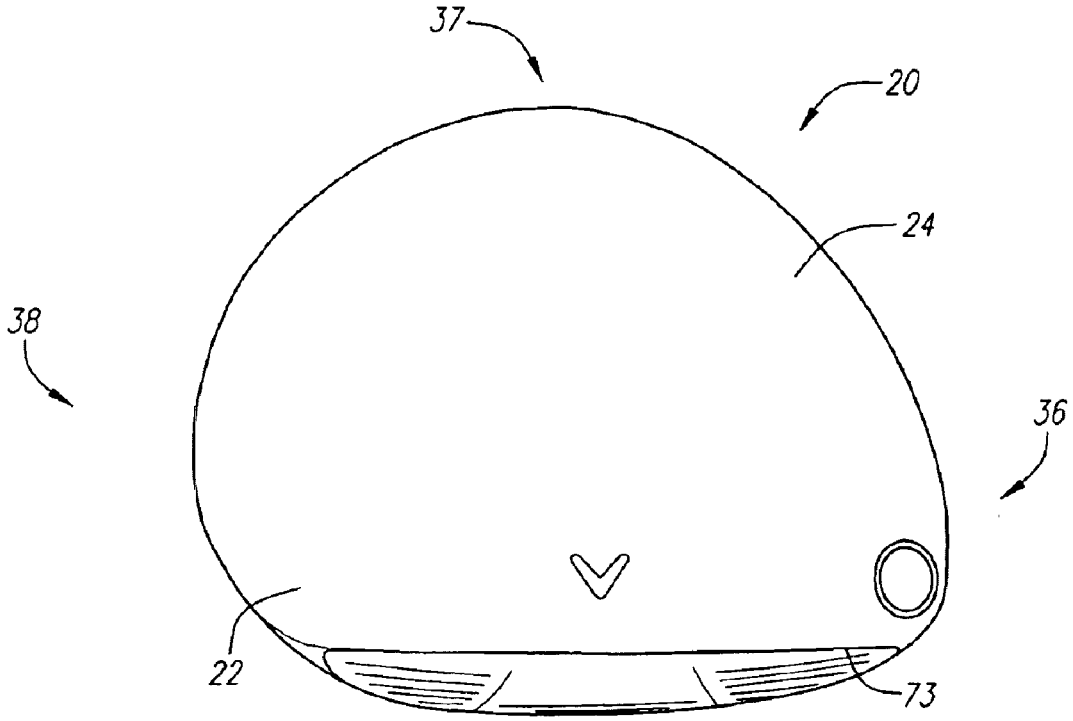
FIG. 24 is a top plan view of the golf club head of FIG. 23.
Figure 25:
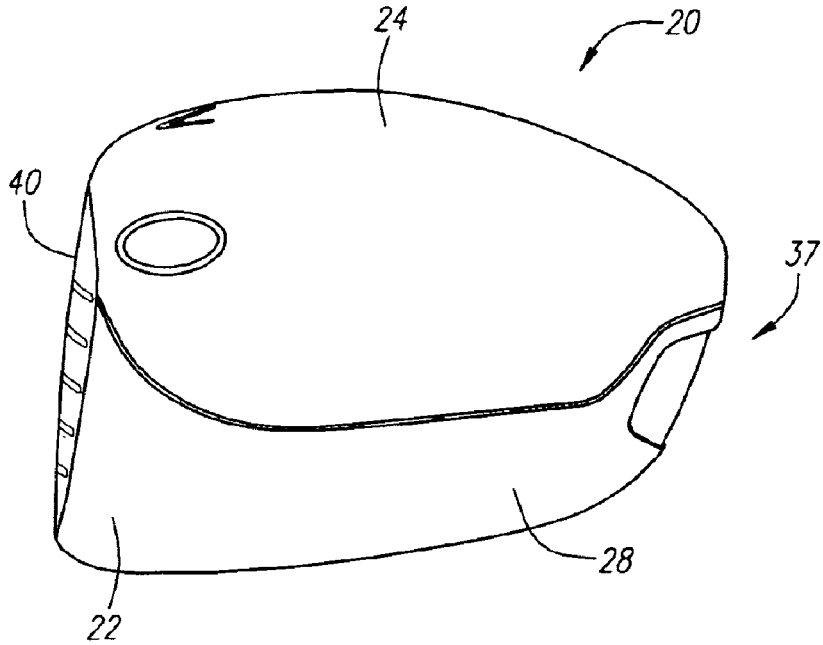
FIG. 25 is a heel side view of the golf club head of FIG. 23.
Figure 26:
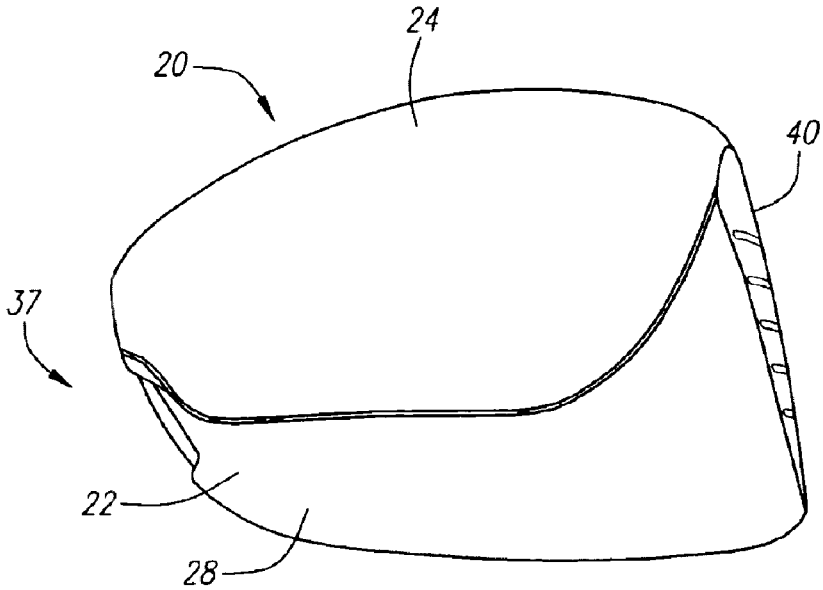
FIG. 26 is a toe side view of the golf club head of FIG. 23.
Figure 27:
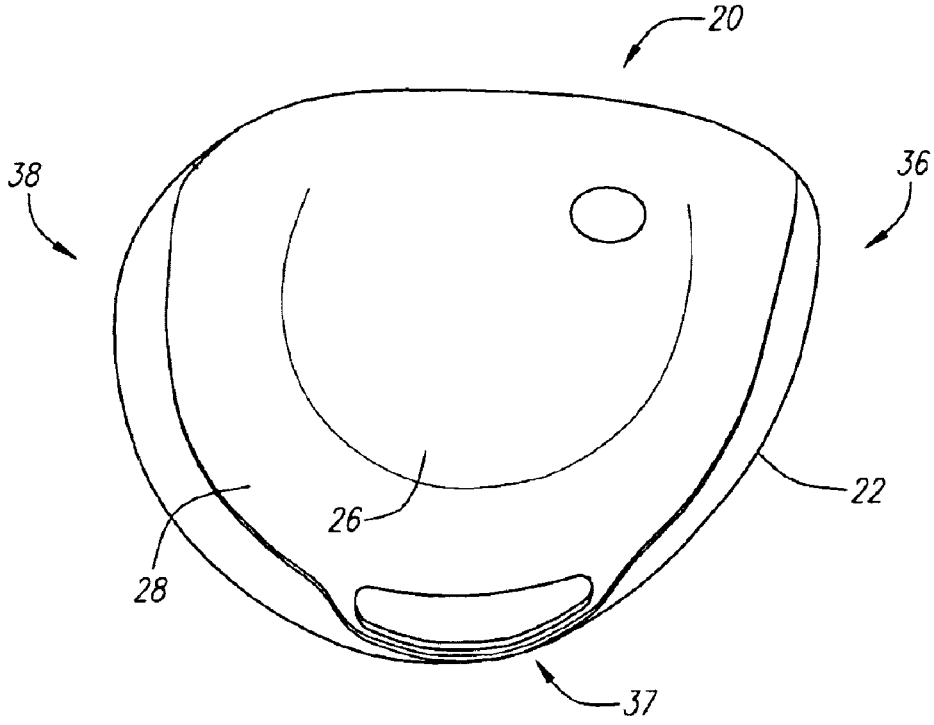
FIG. 27 is a bottom plan view of the golf club head of FIG. 23.
Figure 28:
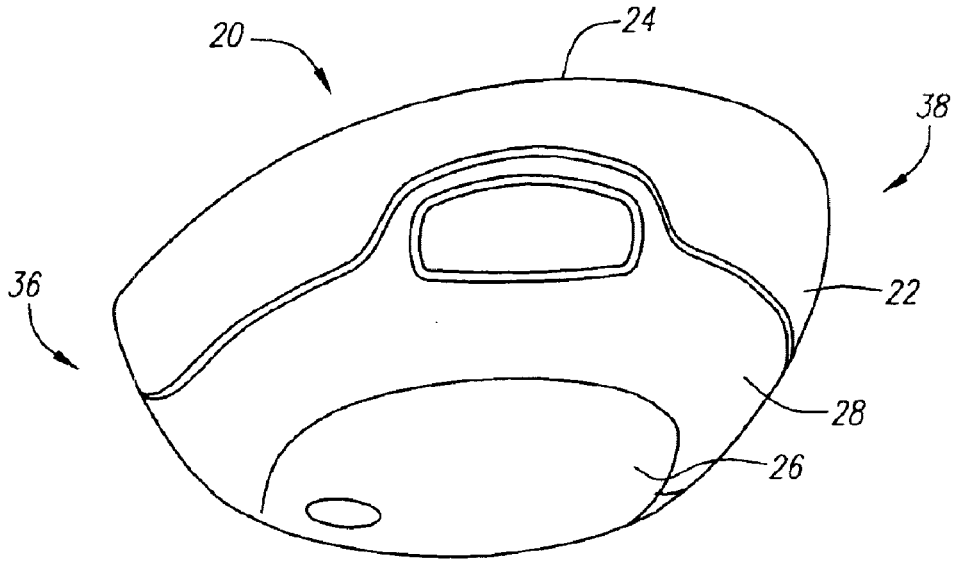
FIG. 28 is a rear perspective view of the golf club head of FIG. 23.

As shown in FIGS. 21–22, the return portion 74 overlaps the undercut portions 62*a* and 64*a* a distance Lo, which preferably ranges from 0.25 inch to 1.00 inch, more preferably ranges from 0.40 inch to 0.70 inch, and is most preferably 0.50 inch. An annular gap 170 is created between an edge 190 of the crown portion 62 and the sole portion 64, and an edge 195 of the return portion 74. The annular gap 170 preferably has a distance $L_G$ that preferably ranges from 0.020 inch to 0.100 inch, more preferably from 0.050 inch to 0.070 inch, and is most preferably 0.060 inch. A projection 175 from an upper surface of the undercut portions 62*a* and 64*a* establishes a minimum bond thickness between the interior surface of the return portion 74 and the upper surface of the undercut portions 62*a* and 64*a*. The bond thickness preferably ranges from 0.002 inch to 0.100 inch, more preferably ranges from 0.005 inch to 0.040 inch, and is most preferably 0.030 inch. A liquid adhesive 200 preferably secures the aft body 61 to the face component 60. A leading edge 180 of the undercut portions 62*a* and 64*a* may be sealed to prevent the liquid adhesive from entering the hollow interior 46.

The crown portion 62 of the aft-body 61 is generally convex toward the sole 64, and engages the ribbon 90 of sole 64 outside of the engagement with the face member 60. The crown portion 62 preferably has a thickness in the range of 0.010 to 0.100 inch, more preferably in the range of 0.025 inch to 0.070 inch, even more preferably in the range of 0.028 inch to 0.040 inch, and most preferably has a thickness of 0.033 inch. The sole portion 64, including the bottom section 91 and the optional ribbon 90 which is substantially perpendicular to the bottom section 91, preferably has a thickness in the range of 0.010 to 0.100 inch, more preferably in the range of 0.025 inch to 0.070 inch, even more preferably in the range of 0.028 inch to 0.040 inch, and most preferably has a thickness of 0.033 inch. The undercut portions 62*a* and 64*a* have a similar thickness to the sole portion 64 and the crown portion 62. In a preferred embodiment, the aft-body 61 is composed of a plurality of plies of pre-preg, typically six or seven plies, such as disclosed in U.S. Pat. No. 6,248,025, entitled Composite Golf Head And Method Of Manufacturing, which is hereby incorporated by reference in its entirety. The bottom section 91 is generally convex toward the crown portion 62. An optional bladder port 135 is located in the sole undercut portion 64*a*.

As shown in FIG. 21, a weighting member 122 is preferably disposed within the hollow interior 34 of the club head 20. The weighting member 122 is preferably tungsten loaded film, tungsten doped polymers, or similar weighting mechanisms such as described in U.S. Pat. No. 6,386,990, filed on Dec. 29, 1999, entitled A Composite Golf Club Head With An Integral Weight Strip, and hereby incorporated by reference in its entirety. Those skilled in the pertinent art will recognize that other high density materials may be utilized as an optional weighting member without departing from the scope and spirit of the present invention.

Yet another embodiment of the golf club head of the present invention is shown in FIGS. 23–28. In this embodiment, the golf club head 20 has a body 22 that is preferably composed of a metal material such as titanium, titanium alloy, or the like, and is most preferably composed of a cast titanium alloy material. A golf club head 20 for a driver with a body 22 composed of a cast titanium alloy most preferably has a volume of 380 cubic centimeters. The body 22 is preferably cast from molten metal in a method such as the well-known lost-wax casting method. The metal for casting is preferably titanium or a titanium alloy such as 6-4 titanium alloy, alpha-beta titanium alloy or beta titanium alloy for forging, and 6-4 titanium for casting. Alternatively, the body 22 is composed of 17-4 steel alloy. Additional methods for manufacturing the body 22 include forming the body 22 from a flat sheet of metal, super-plastic forming the body 22 from a flat sheet of metal, machining the body 22 from a solid block of metal, electrochemical milling the body from a forged pre-form, casting the body using centrifugal casting, casting the body using levitation casting, and like manufacturing methods.

The golf club head 20 of this embodiment optionally has a front wall 30 with an opening 32 for placement of a striking plate insert 40 such as disclosed in U.S. patent application Ser. No. 10/065,712 for A Golf Club Head With A Face Insert, filed on Nov. 12, 2002. The striking plate insert 40 preferably is composed of a formed titanium alloy material. Such titanium materials include titanium alloys such as 6-22-22 titanium alloy and Ti 10-2-3 alloy, Beta-C titanium alloy, all available from RTI International Metals of Ohio, SP-700 titanium alloy (available from Nippon Steel of Tokyo, Japan), DAT 55G titanium alloy available from Diado Steel of Tokyo, Japan, and like materials. The preferred material for the striking plate insert 40 is a heat treated 6-22-22 titanium alloy which is a titanium alloy composed by weight of titanium, 6% aluminum, 2% tin, 2% chromium, 2% molybdenum, 2% zirconium and 0.23% silicon. The titanium alloy will have an alpha phase in excess of 40% of the overall microstructure.

In a preferred embodiment, the striking plate insert 40 has uniform thickness that ranges from 0.040 inch to 0.250 inch, more preferably a thickness of 0.080 inch to 0.120 inch, and is most preferably 0.108 inch for a titanium alloy striking plate insert 40.

Another aspect of the golf club head 20 of the present invention is directed a golf club head 20 that has a high coefficient of restitution for greater distance of a golf ball hit with the golf club head of the present invention. The coefficient of restitution (also referred to herein as "COR") is determined by the following equation:

$$e = \frac{v_2 - v_1}{U_1 - U_2}$$

wherein $U_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution between the golf ball and the club face.

The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. The golf club head 20 preferably has a coefficient of restitution ranging from 0.80 to 0.94, as measured under conventional test conditions.

The coefficient of restitution of the club head 20 of the present invention under standard USGA test conditions with a given ball preferably ranges from approximately 0.80 to 0.94, more preferably ranges from 0.82 to 0.89 and is most preferably 0.86.

Preferably, the striking plate insert 40 has a mass ranging from 40 grams to 90 grams, more preferably ranging from 50 grams to 80 grams, yet more preferably from 55 grams to 75 grams, and most preferably 65 grams. In the preferred embodiment of FIGS. 1–15, the body 22 (without weighting) has a mass preferably ranging from 30 grams to 100 grams, more preferably from 40 grams to 90 grams, even more preferably 60 grams to 80 grams, and most preferably 70 grams. The aft weighting member 50 has a mass preferably ranging from 30 grams to 90 grams, more preferably from 40 grams to 70 grams, and most preferably 55 grams. The hosel 57 preferably has a mass ranging from 3 to 17 grams, more preferably from 8 to 15 grams, and most preferably has a mass of 13 grams. Additionally, epoxy, or other like flowable materials, in an amount ranging from 0.5 grams to 5 grams, may be injected into the hollow interior 34 of the golf club head 20 for selective weighting thereof.

Figure 12:
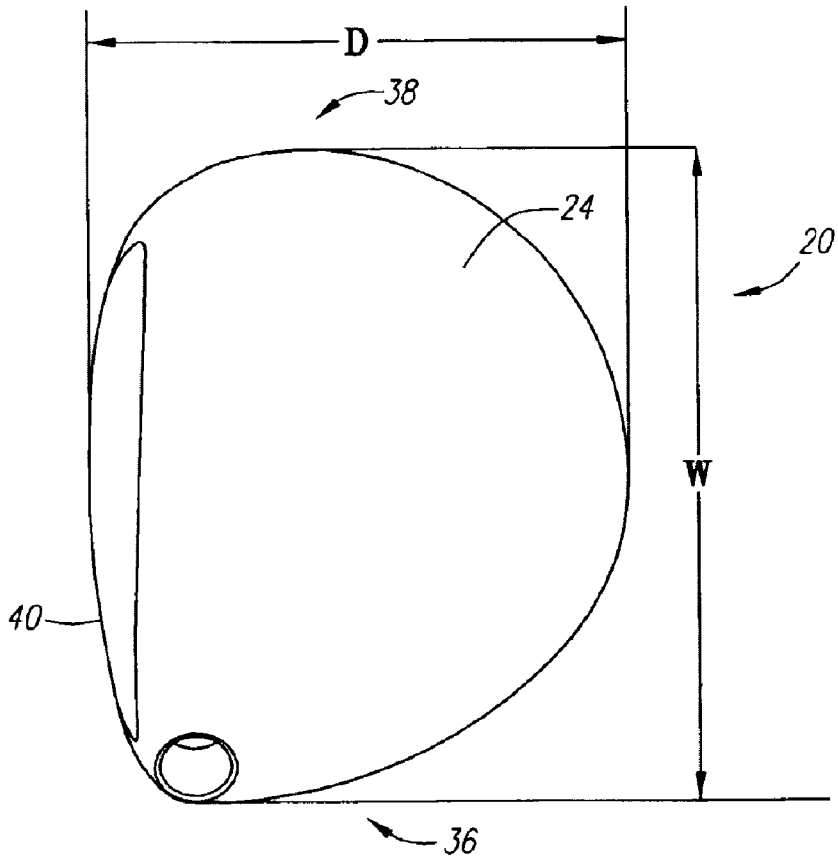
FIG. 12 is a top plan view of a golf club head of the present invention.
Figure 13:
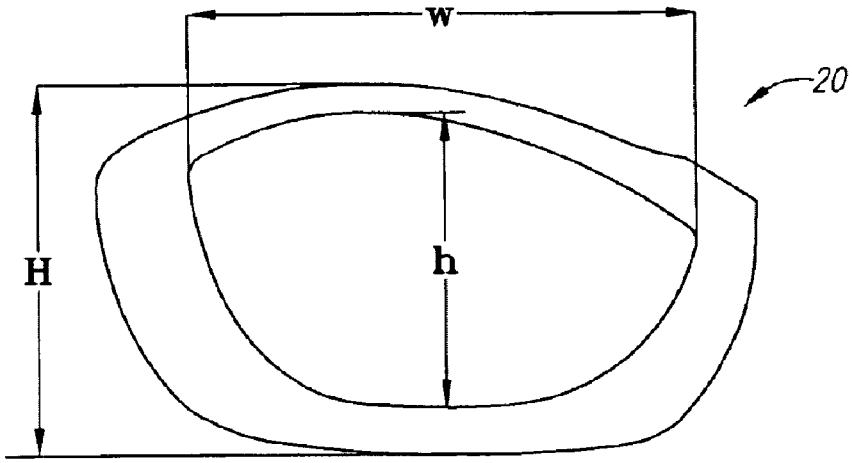
FIG. 13 is a front view of a golf club head of the present invention.

As shown in FIGS. 12 and 13, the depth, "D", of the club head 20 from the front wall 30 to the aft end 37 of the crown 24 preferably ranges from 3.0 inches to 4.5 inches, and is most preferably 3.74 inches. The height, "H", of the club head 20, as measured while in address position from the sole 26 to the crown 24, preferably ranges from 2.0 inches to 3.5 inches, and is most preferably 2.62 inches. The width, "W", of the club head 20 from the toe end 38 to the heel end 36 preferably ranges from 4.0 inches to 5.5 inches, and more preferably 4.57 inches. The height, "h", of the striking plate insert 40, preferably ranges from 1.8 inches to 2.5 inches, and is most preferably 2.08 inches. The width, "w", of the striking plate insert from the toe end to the heel end preferably ranges from 3.0 inches to 5.0 inches, and more preferably 3.52 inches.

Figure 14:
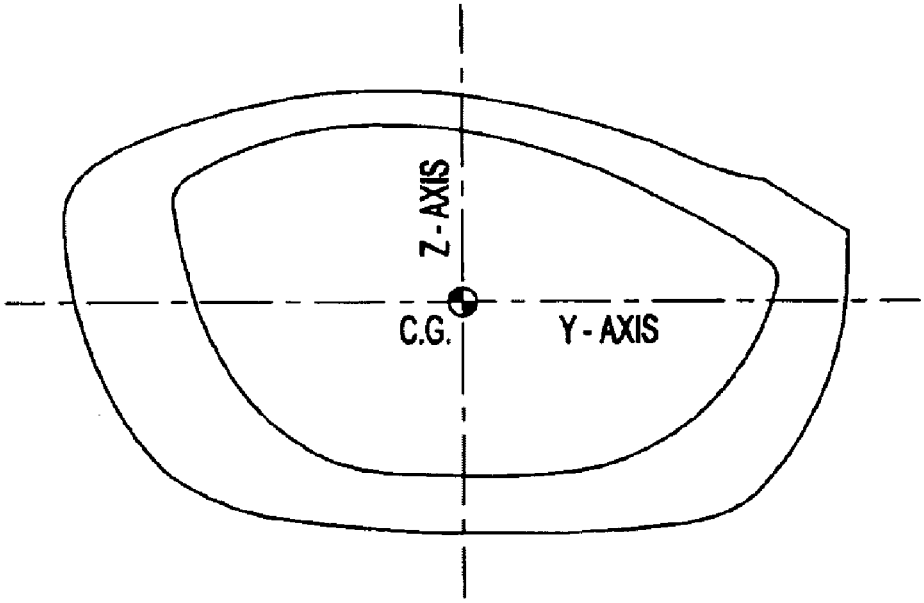
FIG. 14 is a front plan view of a golf club of the present invention illustrating the Z axis and Y axis.
Figure 15:
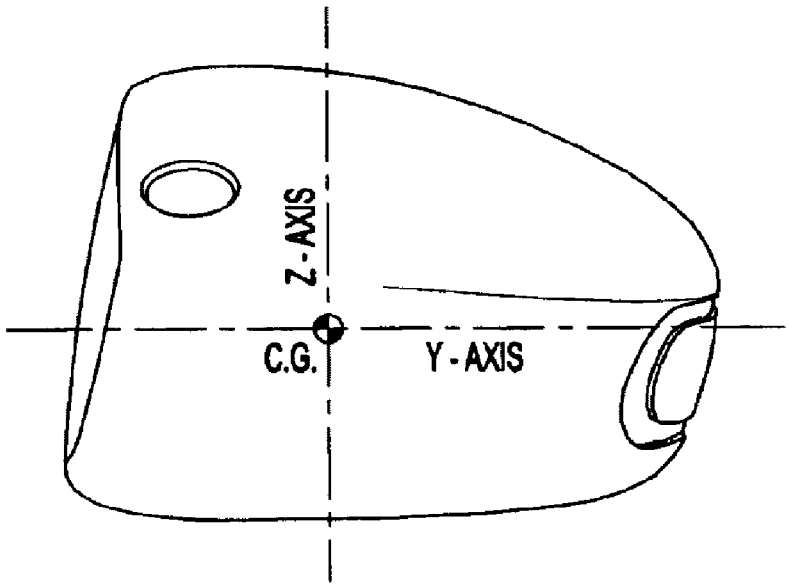
FIG. 15 is a heel side plan view of a golf club of the present invention illustrating the Z axis and X axis.
Figure 16:
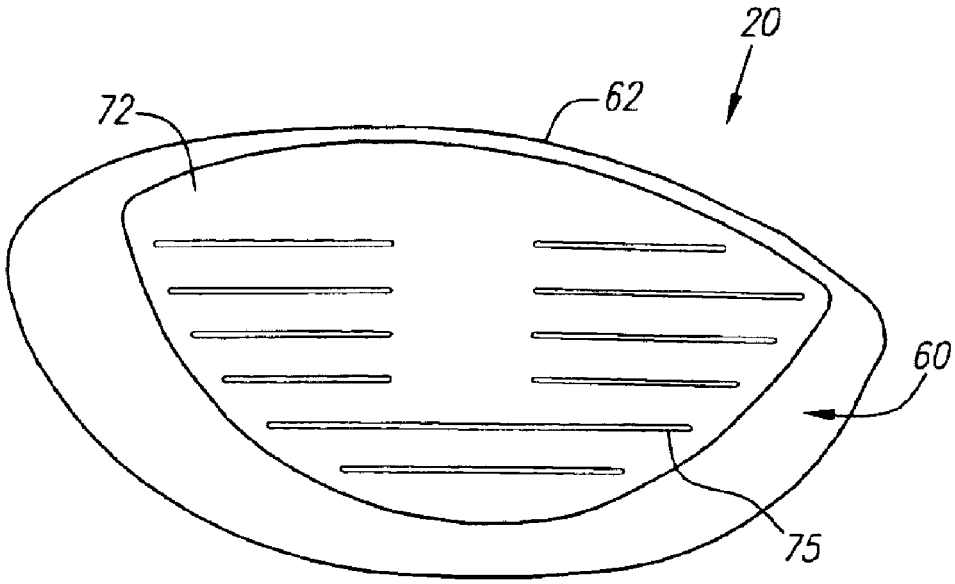
FIG. 16 is a front plan view of an alternative embodiment of a golf club head of the present invention.
Figure 17:
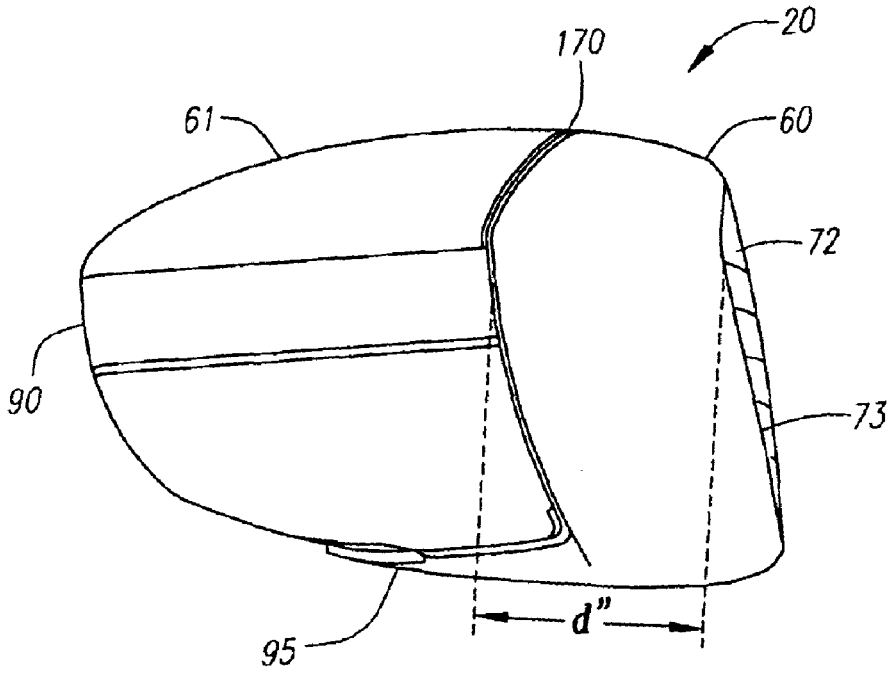
FIG. 17 is a toe side view of the golf club head of FIG. 16.
Figure 18:
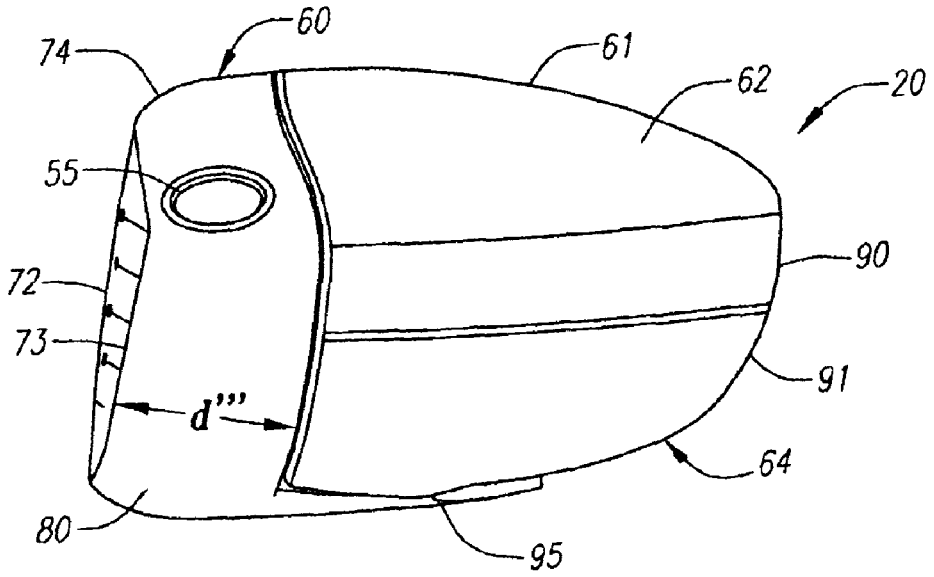
FIG. 18 is a heel side view of the golf club head of FIG. 16.
Figure 19:
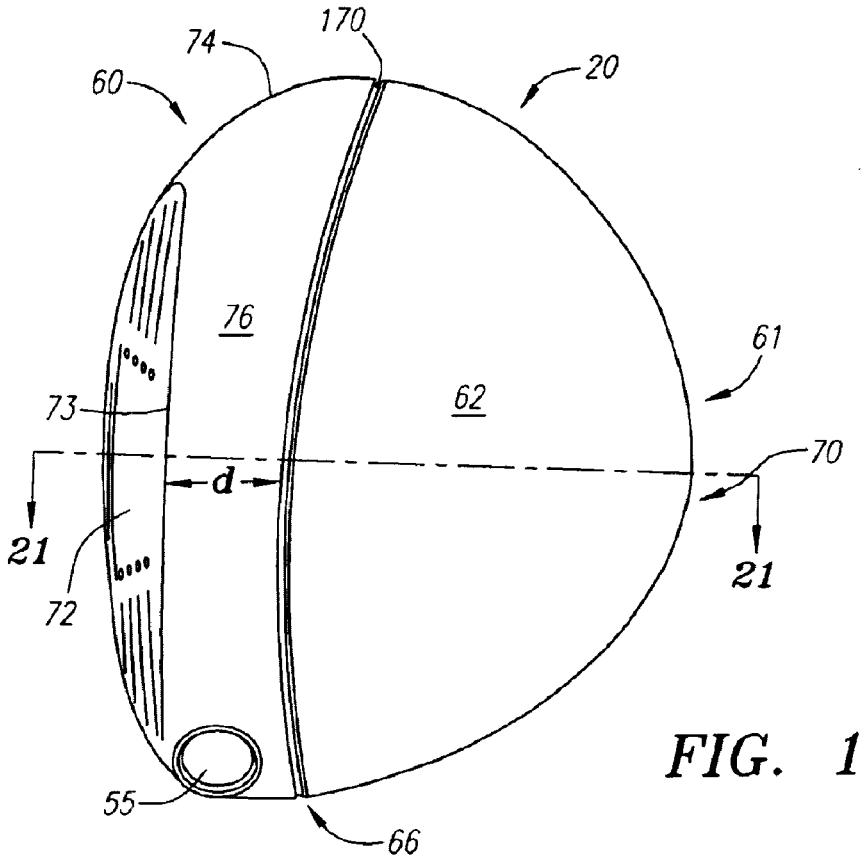
FIG. 19 is a top plan view of the golf club head of FIG. 16.
Figure 20:
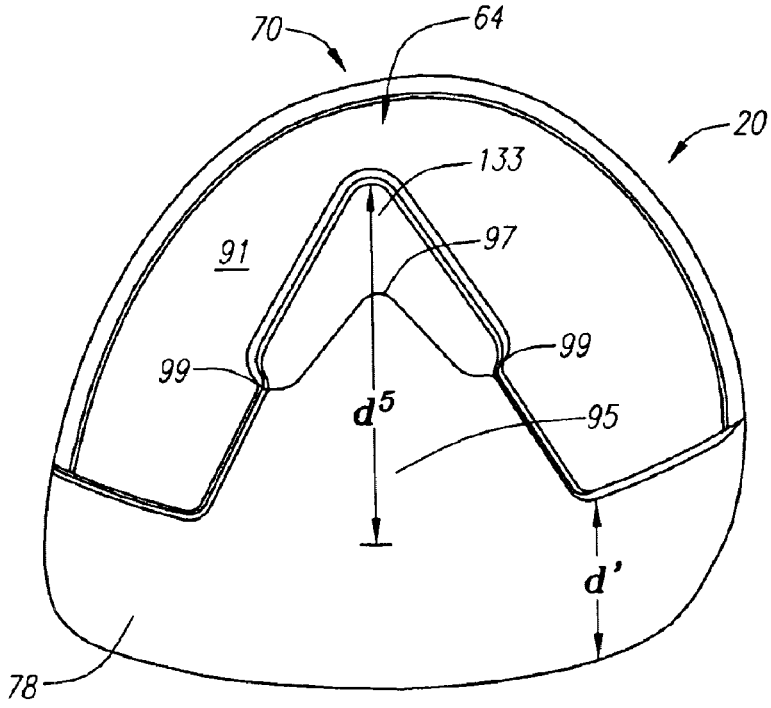
FIG. 20 is a bottom plan view of the golf club head of FIG. 16.

FIGS. 14 and 15 illustrate the axes of inertia through the center of gravity of the golf club head. The axes of inertia are designated X, Y and Z. The X axis extends from the striking plate insert 40 through the center of gravity, CG, and to the rear of the golf club head 20. The Y axis extends from the toe end 38 of the golf club head 20 through the center of gravity, CG, and to the heel end 36 of the golf club head 20. The Z axis extends from the crown 24 through the center of gravity, CG, and to the sole 26.

As defined in *Golf Club Design, Fitting, Alteration & Repair,* $4^{th}$ Edition, by Ralph Maltby, the center of gravity, or center of mass, of the golf club head is a point inside of the club head determined by the vertical intersection of two or more points where the club head balances when suspended. A more thorough explanation of this definition of the center of gravity is provided in *Golf Club Design, Fitting, Alteration & Repair.*

The center of gravity and the moment of inertia of a golf club head 20 are preferably measured using a test frame ($X^T$, $Y^T$, $Z^T$), and then transformed to a head frame ($X^H$, $Y^H$, $Z^H$). The center of gravity of a golf club head may be obtained using a center of gravity table having two weight scales thereon, as disclosed in U.S. Pat. No. 6,607,452, entitled High Moment Of Inertia Composite Golf Club, and hereby incorporated by reference in its entirety. If a shaft is present, it is removed and replaced with a hosel cube that has a multitude of faces normal to the axes of the golf club head. Given the weight of the golf club head, the scales allow one to determine the weight distribution of the golf club head when the golf club head is placed on both scales simultaneously and weighed along a particular direction, the X, Y or Z direction.

In general, the moment of inertia, Izz, about the Z axis for the golf club head 20 of the present invention will range from 2800 g-cm$^2$ to 5000 g-cm$^2$, preferably from 3000 g-cm$^2$ to 4500 g-cm$^2$, even more preferably from 3200 g-cm$^2$ to 4000 g-cm$^2$, and most preferably 3758 g-cm$^2$. The moment of inertia, Iyy, about the Y axis for the golf club head 20 of the present invention will range from 1500 g-cm$^2$ to 4000 g-cm$^2$, preferably from 2500 g-cm $^2$ to 3400 g-cm$^2$, even more preferably from 2900 g-cm$^2$ to 3100 g-cm$^2$, and most preferably 3003 g-cm$^2$. Further, the golf club head 20 of the present invention preferably has good products of inertia such as disclosed in U.S. Pat. No. 6,425,832, which was filed on Jul. 26, 2001 and is hereby incorporated by reference in its entirety.

TABLE ONE

| Example | Face Mass (g) | Butt Mass (g) | Body Mass (g) | Iyy (gcm$^2$) | CG Depth (in.) |
|---|---|---|---|---|---|
| 1 | 65 | 55 | 71 | 3051 | 1.40 |
| 2 | 72 | 45 | 80 | 3013 | 1.25 |
| 3 | 73 | 29 | 97 | 2671 | 1.06 |
| 4 | 75 | 12 | 110 | 2147 | 0.89 |

Figure 29:
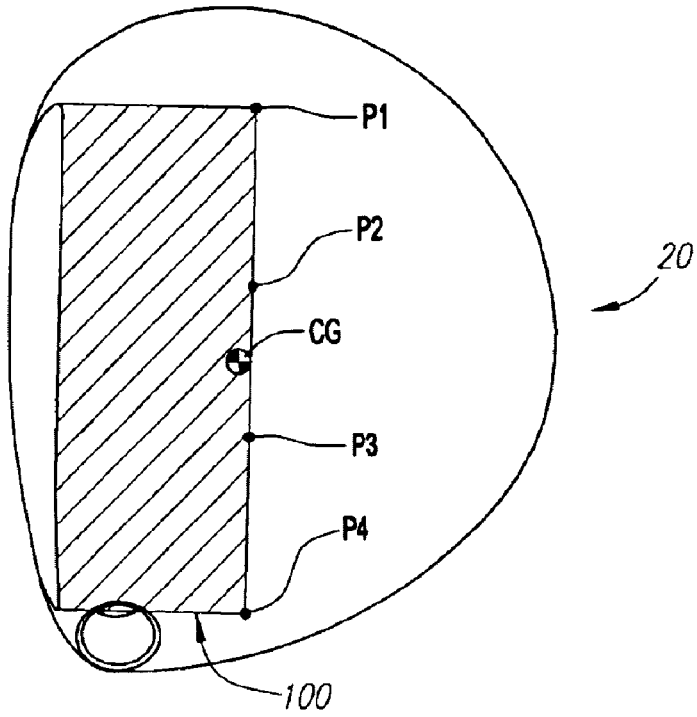
FIG. 29 is a top plan view of a golf club head of the present invention illustrating the CG zone.
Figure 30:
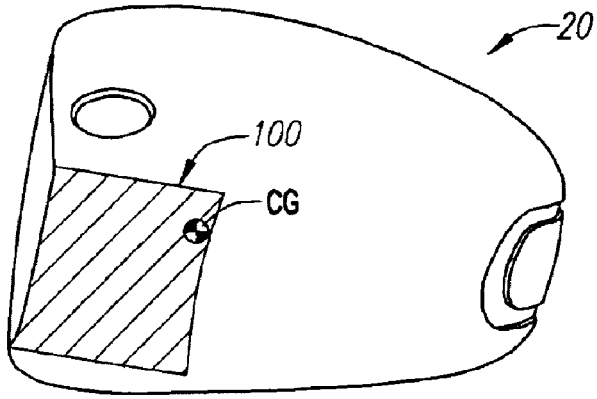
FIG. 30 is a heel side view of the golf club head of FIG. 29 illustrating the CG zone.
Figure 31:
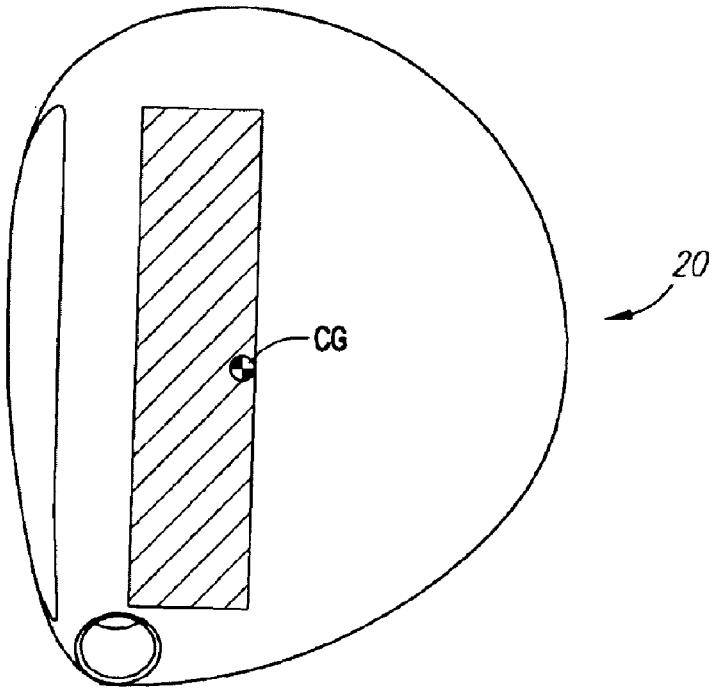
FIG. 31 is a top plan view of a golf club head of the present invention illustrating an alternative embodiment of the CG zone.
Figure 32:
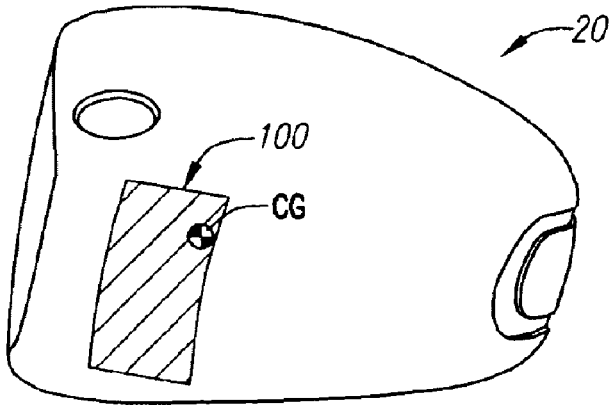
FIG. 32 is a heel side view of the golf club head of FIG. 31 illustrating an alternative embodiment of the CG zone.

Table One discloses measurements for a golf cub head of the first embodiment which is illustrated in FIGS. 1–15. The face mass measurements of Table One refer to the mass of striking plate 40. The butt mass measurements refer to the mass of rear weight member 50. The body niass measurements refer to the mass of the body 22. The moment of inertia, Iyy, about the center of gravity of the golf club head is measured as disclosed above. The center of gravity is measured from the interior surface of the striking plate (or face) 40 of the golf club head 20. As shown in FIGS. 29–30, a center of gravity zone 100 is defined as a zone rearward from the entire striking plate 40 (or front wall or face) of the golf club head 20. For example, a center of gravity located within 1.40 inches from the interior surface of the striking plate 40 includes a volume from the interior surface of the striking plate 40 rearward a distance of 1.40 inches following the bulge and roll of the striking plate 40. Thus, every point P1–P4 along the edge of the CG zone 100 is 1.40 inches along a line from the interior surface of the striking plate 40. The line is perpendicular to the interior surface of the striking plate 40. Alternatively, as shown in FIGS. 31–32, the CG zone is within a specific range from the interior surface of the striking plate 40. For example, in FIGS. 31–32 the range is from 0.75 inch to 1.40 inches from the interior surface of the striking plate 40.

Table Two discloses the mass, volume, center of gravity location and moment of inertia Iyy about the center of gravity for some comparative golf club heads.

TABLE TWO

| Manufacturer | Model | Volume (cc) | Clubhead Mass (g) | Iyy ($gcm^2$) | CG Depth (in.) |
|---|---|---|---|---|---|
| TaylorMade | 360 | 360 | 190 | 2118 | 1.30 |
| TaylorMade | 510 | 330 | 198 | 2083 | 1.19 |
| TaylorMade | 540 | 350 | 197 | 2108 | 1.26 |
| TaylorMade | 580 | 400 | 196 | 2417 | 1.45 |
| TaylorMade | BurnerR420 | 405 | 200 | 2364 | 1.24 |
| Cleveland | Launcher330 | 330 | 201 | 2008 | 1.15 |
| Cleveland | Launcher400 | 400 | 200 | 2358 | 1.26 |
| Cobra | SS350 | 350 | 204 | 2338 | 1.25 |
| Cobra | SS427 | 425 | 197 | 2429 | 1.13 |

Figure 33:
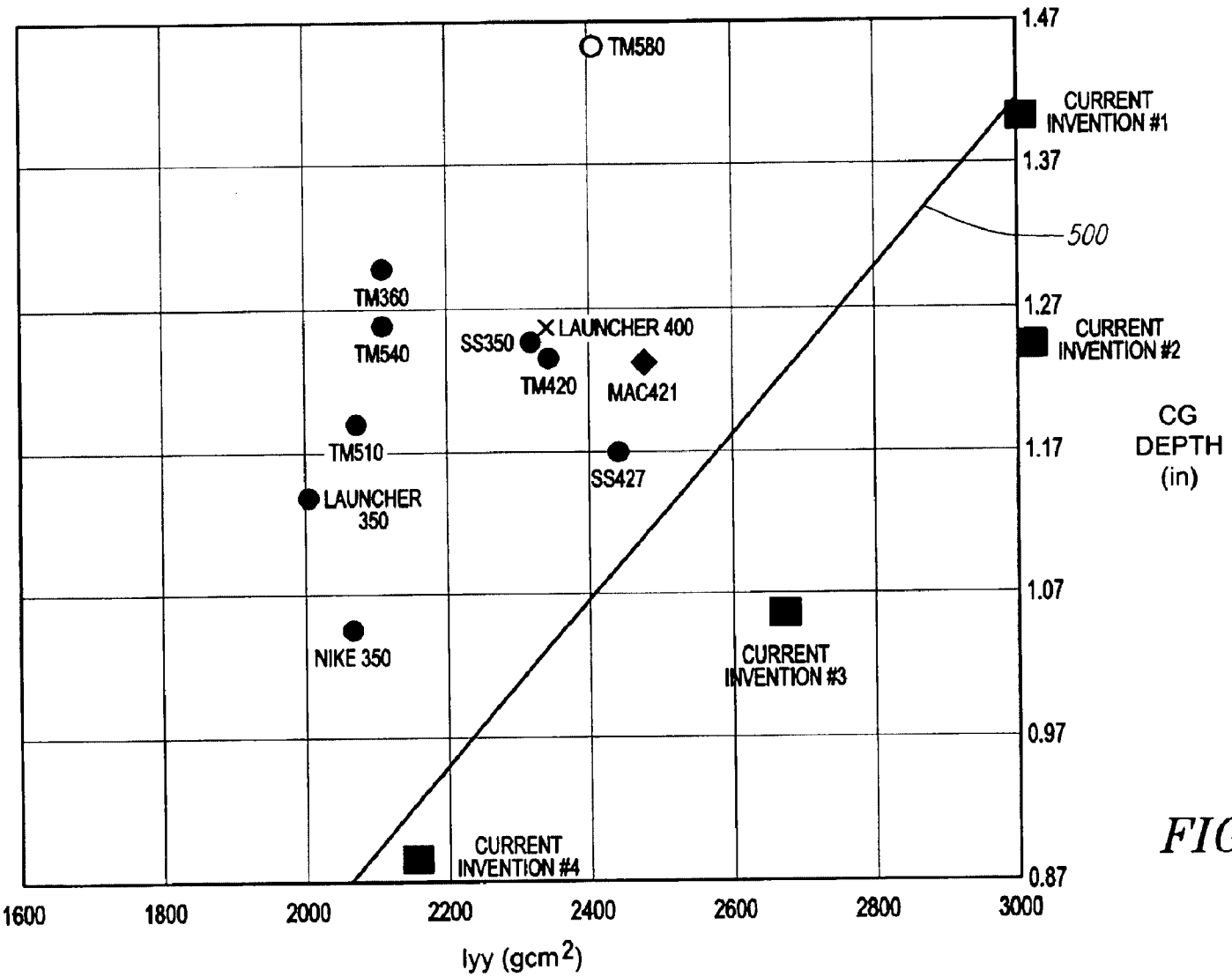
FIG. 33 is a graph of the Iyy versus center of gravity depth.

FIG. 33 is a graph of the moment of inertia Iyy about the center of gravity of a golf club head versus the distance of a center of gravity from the interior surface of a striking plate of a golf club head. The line 500 represents the function Y=f(X)+b, which distinguishes golf club heads of present invention from other golf club heads.

One aspect of the present invention is a golf club head 20 having a center of gravity located less than 1.47 inches from an exterior surface of the striking plate, and a moment of inertia about the Iyy axis through the center of gravity of the golf club head greater than 2500 grams-centimeters squared.

Another aspect of the present invention is a golf club head 20 having a center of gravity located less than 1.27 inches from an exterior surface of the striking plate, and a moment of inertia about the Iyy axis through the center of gravity of the golf club head greater than 2500 grams-centimeters squared.

Another aspect of the present invention is a golf club head 20 having a center of gravity located less than 1.20 inches from an exterior surface of the striking plate, and a moment of inertia about the Iyy axis through the center of gravity of the golf club head greater than 2500 grams-centimeters squared.

Another aspect of the present invention is a golf club head 20 having a center of gravity located less than 1.15 inches from an exterior surface of the striking plate, and a moment of inertia about the Iyy axis through the center of gravity of the golf club head greater than 2400 grams-centimeters squared.

Another aspect of the present invention is a golf club head 20 having a center of gravity located less than 1.10 inches from an exterior surface of the striking plate, and a moment of inertia about the Iyy axis through the center of gravity of the golf club head greater than 2300 grams-centimeters squared.

Another aspect of the present invention is a golf club head 20 having a center of gravity located less than 1.05 inches from an exterior surface of the striking plate, and a moment of inertia about the Iyy axis through the center of gravity of the golf club head greater than 2200 grams-centimeters squared.

Another aspect of the present invention is a golf club head 20 having a center of gravity located less than 1.00 inches from an exterior surface of the striking plate, and a moment of inertia about the Iyy axis through the center of gravity of the golf club head greater than 2000 grams-centimeters squared.

Another aspect of the present invention is a golf club head 20 having a center of gravity located with a range of 0.50 inch to 1.05 inches from an exterior surface of the striking plate, and a moment of inertia about the Iyy axis through the center of gravity of the golf club head ranging from 1600 grams-centimeters squared to 3000 grams-centimeters squared.

Another aspect of the present invention is a golf club head 20 having a center of gravity located with a range of from 0.50 inch to 1.47 inches from an exterior surface of the striking plate, and a moment of inertia about the Iyy axis through the center of gravity of the golf club head ranging from 2500 grams-centimeters squared to 3200 grams-centimeters squared.

Another aspect of the present invention is a golf club head 20 having a center of gravity located with a range of from 0.75 inch to 1.10 inches from an exterior surface of the striking plate, and a moment of inertia about the Iyy axis through the center of gravity of the golf club head ranging from 2100 grams-centimeters squared to 2800 grams-centimeters squared.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

What is claimed is:

1. A golf club head comprising:

a body having a crown, a sole, a front wall with an opening, and a ribbon with an exterior recess opposite the opening, the body composed of a plies of pre-preg material;

a striking plate insert positioned within the opening, the striking plate insert composed of a metal material and having a mass ranging from 40 grams to 80 grams; and a weighting member positioned within the recess of the ribbon, the weighting member having a mass ranging from 15 grams to 60 grams and composed of a metal material;

wherein the golf club head has a center of gravity located less than 1.27 inches from an exterior surface of the striking plate, and a moment of inertia about the Iyy axis through the center of gravity of the golf club head greater than 2500 grams-centimeters squared.

2. The golf club head according to claim 1 wherein striking plate insert is composed of a material selected from the group consisting of a forged metal material, a formed metal material, a machined metal material and a cast metal material.

3. The golf club head according to claim 1 wherein the body has a mass ranging from 50 grams to 90 grams.

4. The golf club head according to claim 1 wherein the moment of inertia about an Izz axis of the golf club head is greater than 3000 grams-centimeter squared.

5. The golf club bead according to claim 1 wherein the striking plate insert is composed of a material selected from the group consisting of titanium, titanium alloy, steel alloys and amorphous metals.

6. The golf club head according to claim 1 wherein the weighting member is composed of a material selected from the group consisting of steel, brass, tungsten, copper, and any alloy thereof.

7. A golf club head comprising:

a crown composed of plies of pre-preg material, a sole composed of plies of pre-preg material, a striking plate composed of a metal material, a ribbon and a rear weighting member disposed within an exterior recess in the ribbon opposite of the striking plate insert;

wherein the golf club head has a center of gravity located less than 1.47 inches from an exterior surface of the striking plate, and a moment of inertia about the Iyy axis through the center of gravity of the golf club head greater than 2500 grams-centimeters squared.

8. A golf club head comprising:

a body having a crown, a sole, a front wall with an opening, and a ribbon with an exterior recess opposite the opening, the body composed of plies of pre-preg material;

a striking plate insert positioned within the opening, the striking plate insert having a uniform thickness in the range of 0.040 inch to 0.250 inch, the striking plate insert composed of a steel alloy material and having a mass ranging from 40 grams to 80 grams; and a weighting member positioned within the recess of the ribbon, the weighting member having a mass ranging from 15 grams to 60 grams;

wherein the golf club head has a coefficient of restitution of 0.82 to 0.89, a volume ranging from 350 cubic centimeters to 450 cubic centimeters, a mass ranging from 190 grams to 230 grams, a moment of inertia about the Izz axis through the center of gravity greater than 3000 grams-centimeter squared, a center of gravity located less than 1.47 inches from an exterior surface of the striking plate, and a moment of inertia about the Iyy axis through the center of gravity of the golf club head greater than 2500 grams-centimeters squared.

* * * * *